US006064342A

United States Patent [19]

Sandhu et al.

[11] Patent Number: 6,064,342

[45] Date of Patent: May 16, 2000

[54] ANTENNA DETACHMENT MECHANISMS AND METHODS

[75] Inventors: Kulbir Singh Sandhu, San Jose; Francis James Canova, Jr., Fremont; Livius Dumitru Chebeleu, Cupertino, all of Calif.

[73] Assignee: 3Com Corporation, Santa Clara, Calif.

[21] Appl. No.: 09/114,439

[22] Filed: Jul. 13, 1998

[51] Int. Cl.[7] ..... H01Q 1/24

[52] U.S. Cl. ..... 343/702; 343/906; 455/90

[58] Field of Search ..... 343/702, 880, 343/882, 906; 455/90; H01Q 1/24

[56] References Cited

U.S. PATENT DOCUMENTS

| | | | |
|---|---|---|---|
| 4,755,822 | 7/1988 | Chesebro | 343/702 |
| 5,440,315 | 8/1995 | Wright et al. | 343/702 |
| 5,617,106 | 4/1997 | Tahmassebpur | 343/702 |
| 5,640,689 | 6/1997 | Rossi | 455/89 |
| 5,734,716 | 3/1998 | Kulberg | 379/433 |
| 5,752,204 | 5/1998 | Epperson et al. | 455/575 |

*Primary Examiner*—Hoanganh Le
*Assistant Examiner*—Shih-Chao Chen
*Attorney, Agent, or Firm*—Wilson, Sonsini, Goodrich & Rosati

[57] ABSTRACT

Systems and methods are described for detachable antennas. A wireless communications device includes: a cam body defining a rotation axis, the cam body including a retaining zone having a snap-fit receptacle; a signal pin including a first signal pin end and a second signal pin end; an antenna conductively coupled to the first signal pin end; and a key pin that extends from the signal pin, the key pin having a first key pin end and a second key pin end, and being snap-fit into the snap-fit receptacle. The systems and methods provide advantages in that the detachable antenna is easily replaced without tools.

45 Claims, 21 Drawing Sheets

ANTENNA DETACHMENT MECHANISMS AND METHODS

BACKGROUND OF THE INVENTION

1. Field of the Invention

The invention relates generally to the field of radio frequency (RF) communications. More particularly, the invention relates to RF antennas that can be detached from a wireless communication device, especially a personal data assistant.

2. Discussion of the Related Art

Prior art personal data assistants, sometimes called PDAs, are known to those skilled in the art. A transfer of data with a personal data assistant is typically enabled by physically connecting the personal data assistant to another electronic device (e.g., a personal computer) with a serial cable. The transfer of data can then take place between the personal data assistant and the other electronic device via electrical signals that are carried by the serial cable.

More recently, the transfer of data with the personal data assistant has become possible by optically connecting the personal data assistant to the other electronic device (e.g., a second personal data assistant). The transfer of data can then take place between the personal data assistant and the other electronic device via optical signals (e.g., infrared band) that are propagated through free space.

A problem with this personal data assistant data transfer technology has been that, for the transfer of data to take place, the personal data assistant must either be physically connected to the other electronic device or within a short line of sight distance to the other electronic device. Therefore, what is needed is solution that permits a transfer of data between the personal data assistant and another electronic device even when a physical or optical connection is not possible.

Meanwhile, it has been known in the field of communications to provide a radio frequency (RF) communications device with a compact antenna. Prior art RF communication devices, such as cellular phones, are known to those skilled in the art. Cellular phones are usually provided with a compact antenna. To minimize the overall size of such a communications device, these compact antennas are often provided in a deployable/retractable form so that the compact antenna can be at least partially withdrawn into the balance of the communications device during those times when data transfer it not needed. Cellular phones are typically provided with a longitudinally extending compact antenna.

A problem with this compact antenna technology has been that compact antennas are susceptible to mechanical failure. Repeated deployment and retraction of the compact antenna can lead to weakening of the mechanism and, eventually, breakage. Further, compact antennas are inherently fragile because of their small size and weight.

Despite their susceptibility to wear and damage, most compact antennas are not replaceable. Even in the case of compact antennas that are replaceable, the replacement operation is not easy and requires the use of tools to disassemble the communications device, replace the antenna subassembly, and then reassemble the communications device. Therefore, what is also needed is a solution that provides permits a compact antenna to be quickly and easily replaced by the end user of the communications device, without any tools.

Heretofore, the two requirements of wireless, beyond line of sight data transfer with a personal data assistant and easy replacement of a deployable/retractable compact antenna referred to above have not been fully met. What is needed is a solution that simultaneously addresses both of these requirements.

SUMMARY OF THE INVENTION

A primary object of the invention is to provide a detachable antenna. Another primary object of the invention is to provide a wireless communications device, for example, a personal data assistant, with a detachable antenna. Another primary object of the invention is to provide a method of deploying and/or retracting a detachable antenna.

In accordance with these objects, there is a particular need for a detachable antenna that can be reversibly snap-fit into a communications device. Thus, it is rendered possible to simultaneously satisfy the above-discussed requirements of beyond line of sight data transfer with a personal data assistant and easy replacement of a deployable/retractable compact antenna, which, in the case of the prior art, are not simultaneously satisfied.

A first aspect of the invention is implemented in an embodiment that is based on a detachable antenna, comprising: a cam body defining a rotation axis, said cam body including a retaining zone having a snap-fit receptacle; a signal pin including a first signal pin end and a second signal pin end; an antenna conductively coupled to said first signal pin end; and a key pin that extends from said signal pin, said key pin having a first key pin end and a second key pin end, and being snap-fit into said snap-fit receptacle. A second aspect of the invention is implemented in an embodiment that is based on a method of attaching a detachable antenna to a wireless communications device, said method, comprising: providing a detachable antenna that includes a signal pin and a key pin connected to said signal pin; inserting said key pin and at least part of said signal pin into a cam body that composes said wireless communications device so as to define a first detachable antenna position; and deflecting said detachable antenna from said first position to a second position. A third aspect of the invention is embodied in a method of detaching a detachable antenna from a wireless communications device, said method comprising: providing said detachable antenna with a signal pin and a key pin connected to said signal pin; deflecting said detachable antenna from a first position to a second position; and removing said key pin and at least part of said signal pin from a cam body that composes said wireless communications device.

These, and other, objects and aspects of the invention will be better appreciated and understood when considered in conjunction with the following description and the accompanying drawings. It should be understood, however, that the following description, while indicating preferred embodiments of the invention and numerous specific details thereof, is given by way of illustration and not of limitation. Many changes and modifications may be made within the scope of the invention without departing from the spirit thereof, and the invention includes all such modifications.

BRIEF DESCRIPTION OF THE DRAWINGS

A clear conception of the advantages and features constituting the invention, and of the components and operation of model systems provided with the invention, will become more readily apparent by referring to the exemplary, and therefore nonlimiting, embodiments illustrated in the drawings accompanying and forming a part of this specification, wherein like reference characters (if they occur in more than one view) designate the same parts. It should be noted that the features illustrated in the drawings are not necessarily drawn to scale.

DESCRIPTION OF PREFERRED EMBODIMENTS

The invention and the various features and advantageous details thereof are explained more fully with reference to the nonlimiting embodiments that are illustrated in the accompanying drawings and detailed in the following description. Descriptions of well known components and processing techniques are omitted so as not to unnecessarily obscure the invention in detail.

The context of the invention is radio frequency (RF) communications between wireless communications devices. The RF communications can be analog or digital. The RF communications can be spread spectrum. The wireless communications devices can include a personal data assistant (e.g., computer with a touch sensitive screen, also known as (aka) a pen based computer).

The invention can also utilize data processing methods that convert a change in the detachable antenna position to a transformation of one, or more, electrical signals so as to actuate interconnected discrete hardware elements; for example, to couple electrical power to a display on a wireless communications device when the detachable antenna is deflected through an angular position. Another example would be to disable the transmitting function of a wireless communications device when the detachable antenna is removed from the wireless communications device, and re-enable the transmitting function when the detachable antenna is replaced.

Figure 1:
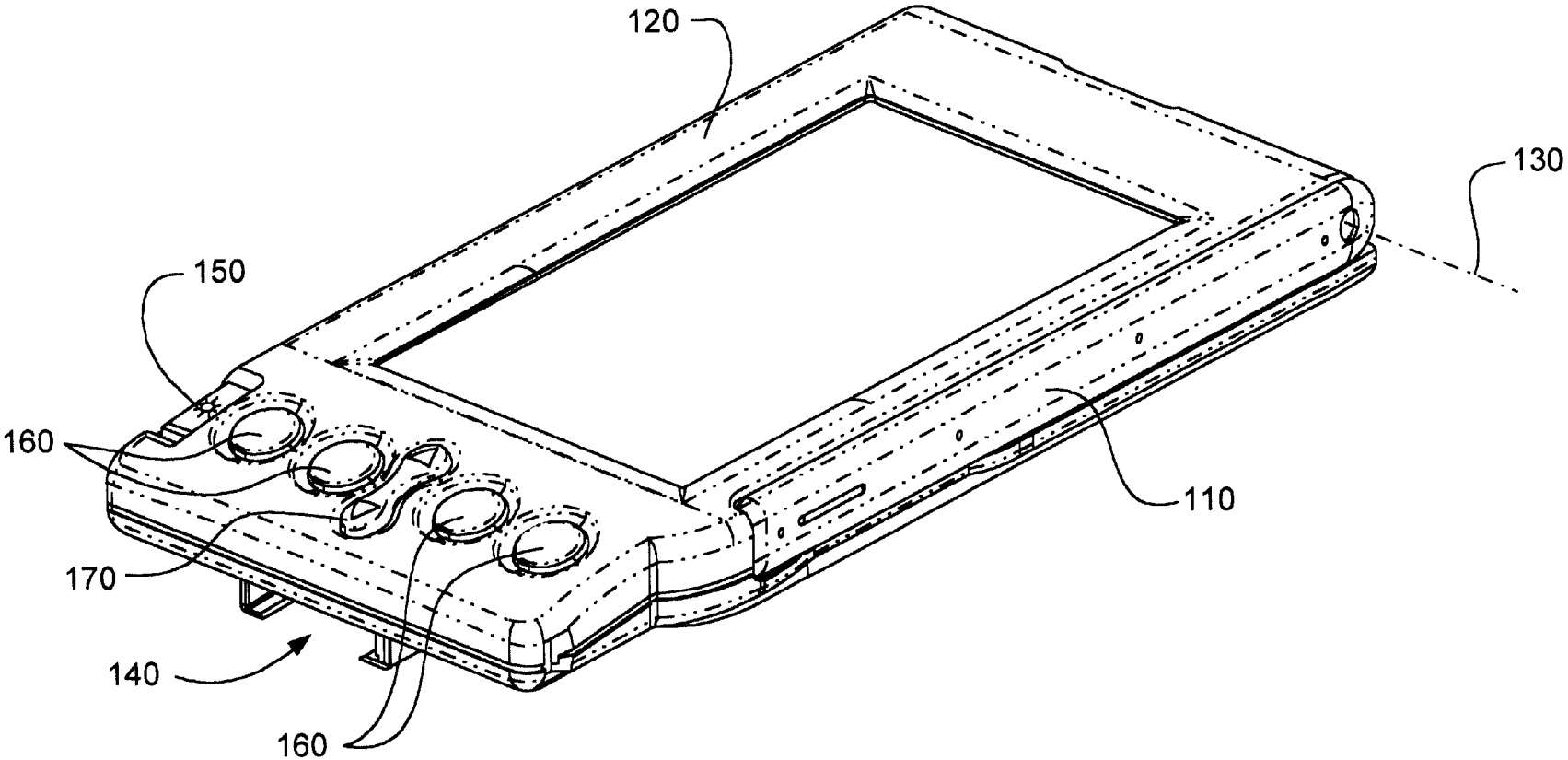
FIG. 1 illustrates a perspective view of a wireless communications device with a detachable antenna positioned at approximately zero degrees, representing an embodiment of the invention.

Referring to FIG. 1, a detachable antenna 110 is mechanically coupled to a wireless communications device 120. Although the embodiment shown in FIG. 1 is based on the wireless communications device 120, it is within the level of ordinary skill in the art after having knowledge of the invention disclosed herein to combine the detachable antenna 110 with any static or mobile communications device, for instance, a receiver (such as a pager), a transmitter (such as a transponder), or a transceiver (such as a cellular phone).

Still referring to FIG. 1, the detachable antenna 110 is depicted positioned at an angular position of approximately zero degrees. The designation of the illustrated position as zero degrees, while arbitrary, can be appreciated to correspond to a closed, compact position in the context of the embodiment shown in FIG. 1. The detachable antenna is shown in a first (e.g., off) position where the antenna is disposed along one side of the wireless communications device. The detachable antenna 110 can be radially deflected about a rotation axis 130. From the position depicted in FIG. 1, this radial deflection will be clockwise with regard to a view point to the right of the wireless communications device 120 and along the rotation axis 130. The detachable antenna 110 is user replaceable. The detachable antenna 110 can be a monopole antenna.

Still referring to FIG. 1, the wireless communications device 120 includes a data port 140. The wireless communications device 120 includes an on/off (e.g., display power) switch 150. The wireless communications device 120 includes a plurality of application buttons 160. The application buttons 160 can also be navigational/message buttons. The wireless communications device 120 includes a scrolling button 170. The scrolling button 170 can be a rocker switch, either a two-way rocker switch as illustrated, or a more than two-way rocker switch (e.g., a four-way rocker switch). Last, but not least, the wireless communications device 120 includes a screen 180. The screen 180 can also be termed a display.

Figure 2:
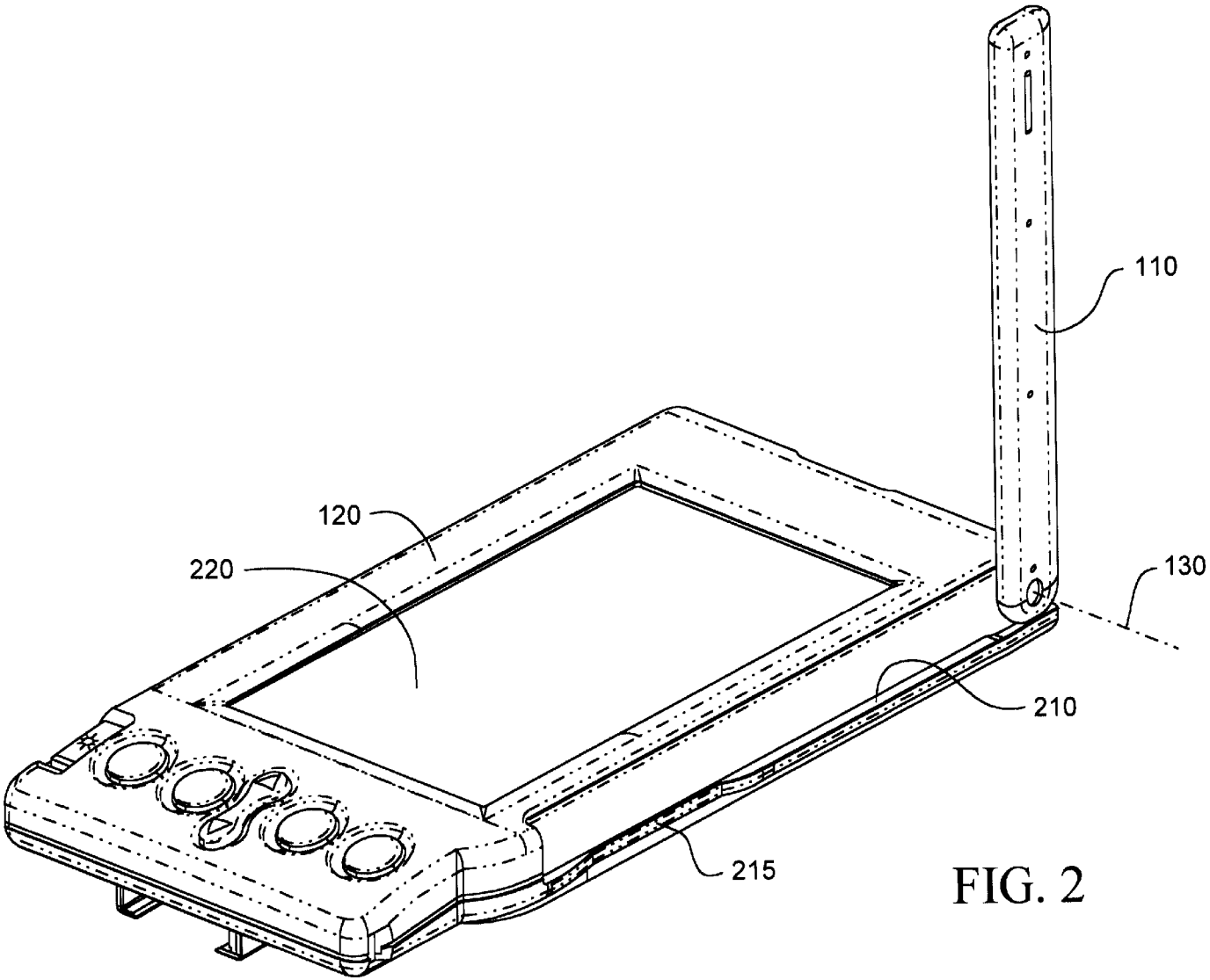
FIG. 2 illustrates a perspective view of the wireless communications device shown in FIG. 1 with the detachable antenna positioned at approximately 90 degrees, representing an embodiment of the invention.

Referring to FIG. 2, the detachable antenna 110 is depicted in a deployed position of approximately 90 degrees. This position of approximately 90 degrees is relative to the position shown in FIG. 1 which has been arbitrarily denoted as zero degrees. In order to reach the deployed position depicted in FIG. 2, the detachable antenna 110 is swung radially about the rotation axis 130, in a clockwise direction with regard to a viewpoint taken from the right of the wireless communications device 120 along the rotation axis 130. It should be noted that the movement of the detachable antenna 110 through an angular position (e.g., 70 degrees) can actuate one, or more, features of the wireless communications device 120 (e.g., turn on the power to the display). However, it should be noted that this actuation feature is optional.

Still referring to FIG. 2, the wireless communications device 120 includes a closure ridge 210. It can be appreciated that the detachable antenna 110 rests against the closure ridge 210 when the detachable antenna 110 is not in a deployed condition. The detachable antenna cannot be deflected in a counter-clockwise direction, with regard to a viewpoint to the right of the wireless communications device 120 and along the rotation axis 130, when the detachable antenna rests against the closure ridge 210. Thus, the closure ridge 210 functions as a stop for the detachable antenna.

Still referring to FIG. 2, the closure ridge 210 includes a ridge recess 215. The ridge recess 215 is formed in the closure ridge 210. In this embodiment, the closure ridge 210 has had some of the material removed from the lower half of the closure ridge 210. The purpose of the ridge recess 215 is to provide clearance for a finger (e.g., thumb) to more easily contact the bottom edge of the detachable antenna 110 and deflect the detachable antenna 110 in a clockwise direction when the detachable antenna is positioned against the closure ridge 210. This allows an operator to more easily grasp the lower edge of the detachable antenna 110 when the detachable antenna 110 is in a closed (i.e., 0 degree) position Referring to FIG. 3, the detachable antenna 110 is depicted in a deployed position of approximately 135 degrees. To be deployed in the position depicted in FIG. 3, the detachable antenna 110 is swung into this position by rotation about the rotation axis 130. A detent mechanism within the wireless communications device 120 can exert a restorative force against the detachable antenna 110 that helps to keep the detachable antenna in this 135 degree position. Such a restorative force can be exerted against the detachable antenna 110 at other angular positions (e.g., 90 and 180 degrees, and multiples thereof). The detent mechanism will be discussed below in more detail.

Figure 3:
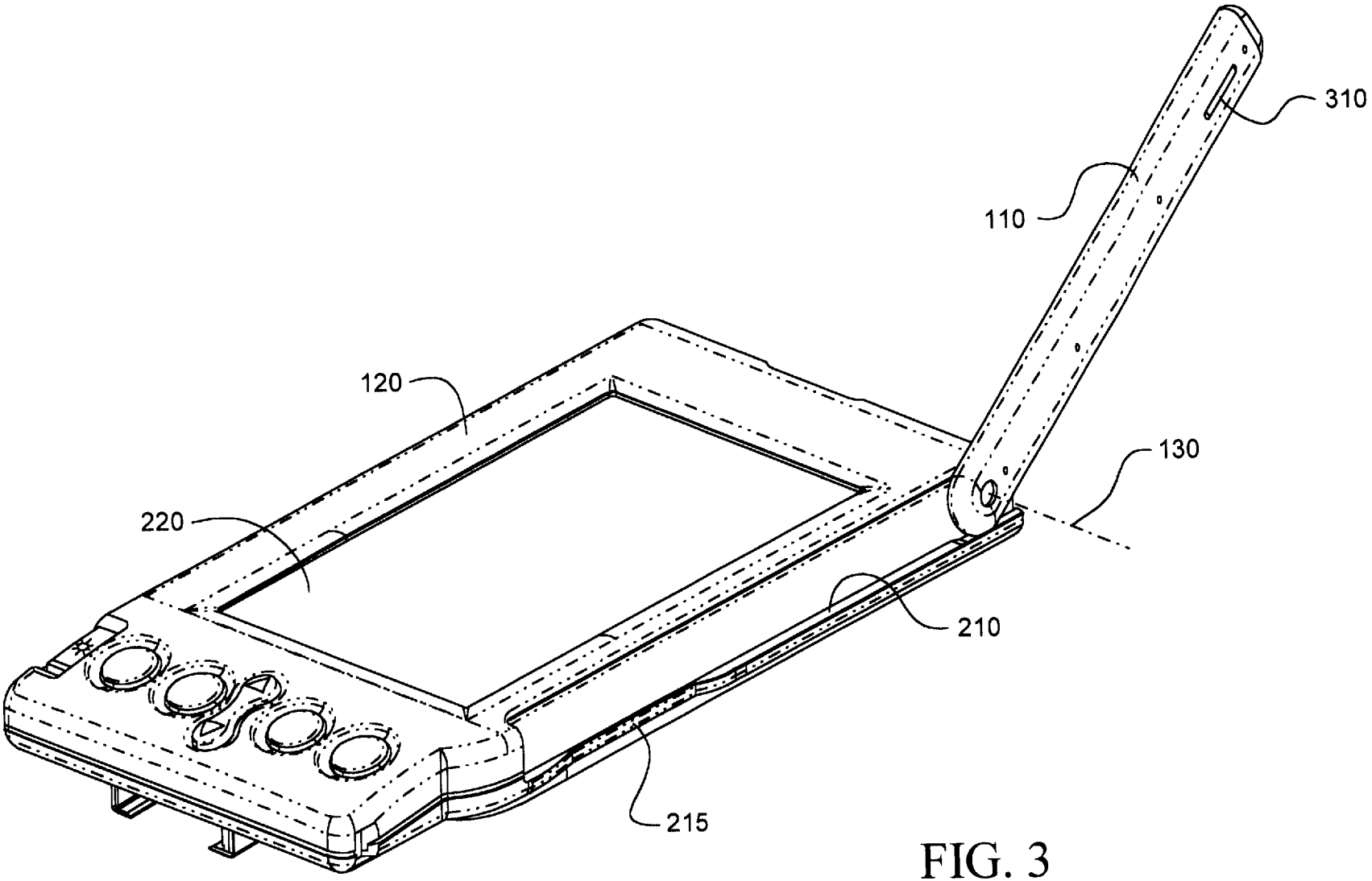
FIG. 3 illustrates a perspective view of the wireless communications device depicted in FIGS. 1–2 with the detachable antenna positioned at approximately 135 degrees, representing an embodiment of the invention.

Still referring to FIG. 3, a rib 310 is located at the upper end of the detachable antenna 110. The rib 310 is for frictional engagement with the finger of an operator, thereby providing a better grip when deflecting the detachable antenna 110. The rib 310 protrudes from the side of the detachable antenna 110.

Figure 4:
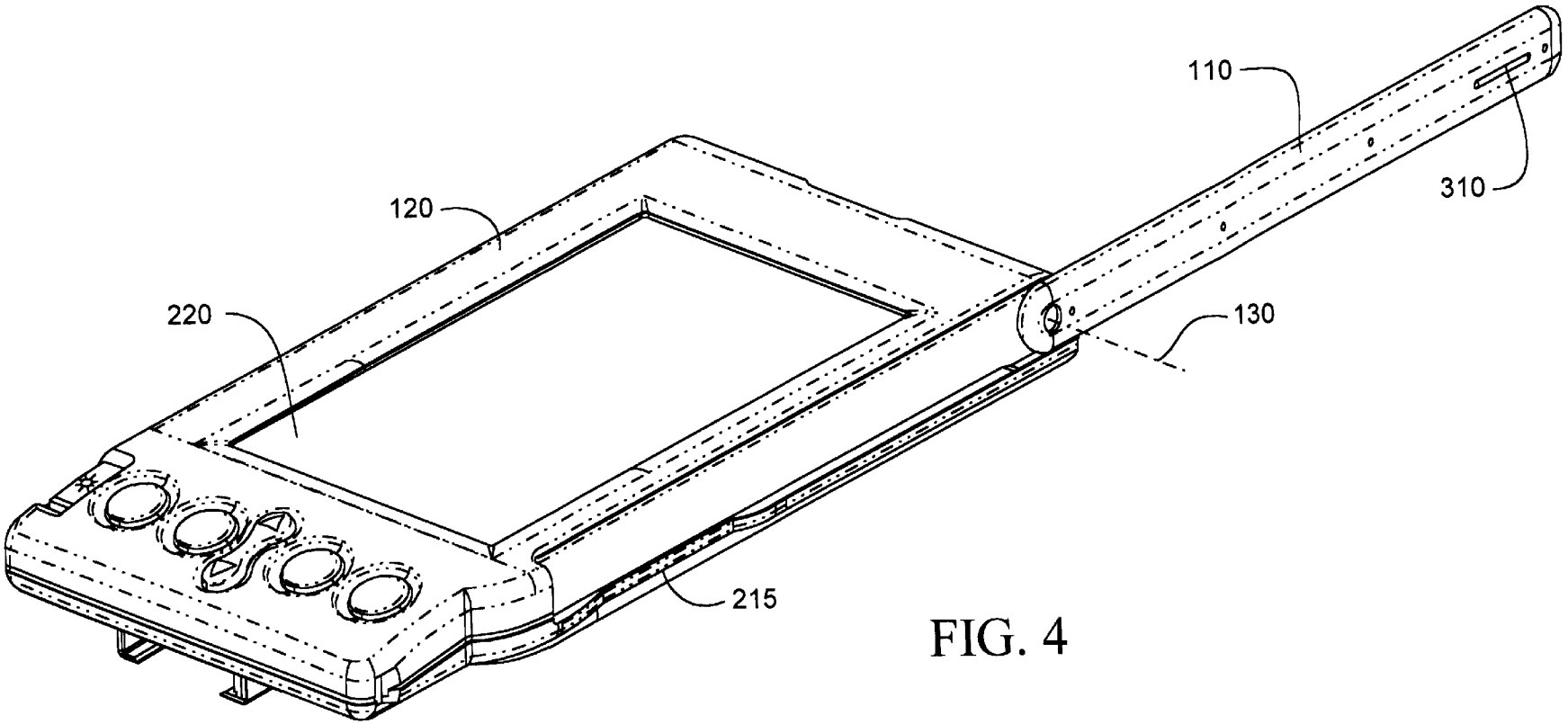
FIG. 4 illustrates a perspective view of the wireless communications device shown in FIGS. 1–3 with the detachable antenna positioned at approximately 180 degrees, representing an embodiment of the invention.

Referring to FIG. 4, the detachable antenna 110 is depicted in a deployed position of approximately 180 degrees. The detachable antenna 110 is deployed to the position of approximately 180 degrees by radially swinging the detachable antenna 110 about the rotation axis 130. In this position, the detachable antenna 110 can be manually removed from the wireless communications device 120, without tools.

Still referring to FIG. 4, the detachable antenna 110 can be removed from the wireless communications device 120 without tools by aligning the detachable antenna 110 with the 180 degree position and then moving the detachable antenna 110 away from the wireless communications device 120 along a direction perpendicular to the rotation axis 130. This movement away from the wireless communications device 120 may require enough force to overcome a snap-fit retainment mechanism within the wireless communications device 120. Further, the detachable antenna 110 can then be reattached to the wireless communications device 120 without tools by aligning the detachable antenna 110 with the 180 degree position and moving the detachable antenna 110 toward the wireless communications device 120 along the rotation axis 130. This movement toward the wireless communications device 120 may require enough force to overcome the resistance presented by the snap-fit retainment mechanism. The snap-fit retainment mechanism will be discussed in more detail below.

Still referring to FIG. 4, it should be noted that the removal and/or replacement feature(s) of the detachable antenna 110 can provided at any angular position, and not necessarily with just the 180 degree position. For example, in other embodiments, the option to remove and/or replace the detachable antenna 110 can be provided at a 270 degree position instead of, or in addition to, the 180 degree position.

Still referring to FIG. 4, the removal of the detachable antenna 110 from the wireless communications device 120 can actuate one, or more, features of the wireless communications device 120 (e.g., disable the transmitting function (s) of the wireless communications device 120 to prevent damage to the electronic circuits). However, this disable feature, or any other actuation associated with removal of the detachable antenna 110 is optional. Similarly, replacement of the detachable antenna 110 can actuate one, or more, features of the wireless communications device 120 (e.g., enable the transmitting function(s)). The removal and reattachment of the detachable antenna 110 will be discussed below in more detail. As above, this enable feature, or any other actuation associated with replacement of the detachable antenna 110 is optional. It should be noted that any actuation features associated with removal and/or replacement of the detachable antenna 110 can be provided at any angular positions that correspond to the ability to remove and/or replace the detachable antenna 110, and not necessarily only at the 180 degree position.

Figure 5:
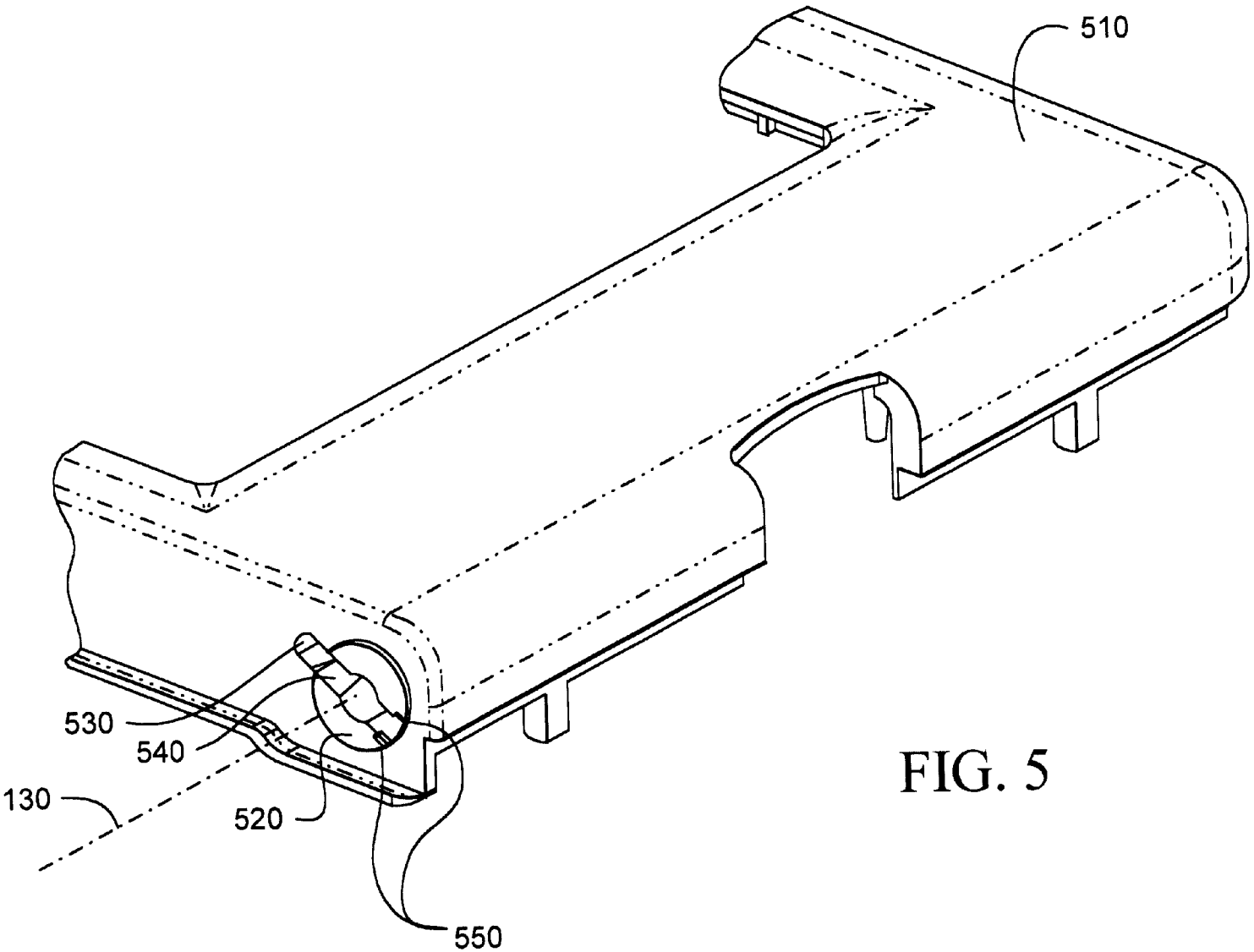
FIG. 5 illustrates a perspective view of the outside of a front housing of the wireless communications device together with a cam body, representing an embodiment of the invention.
Figure 21:
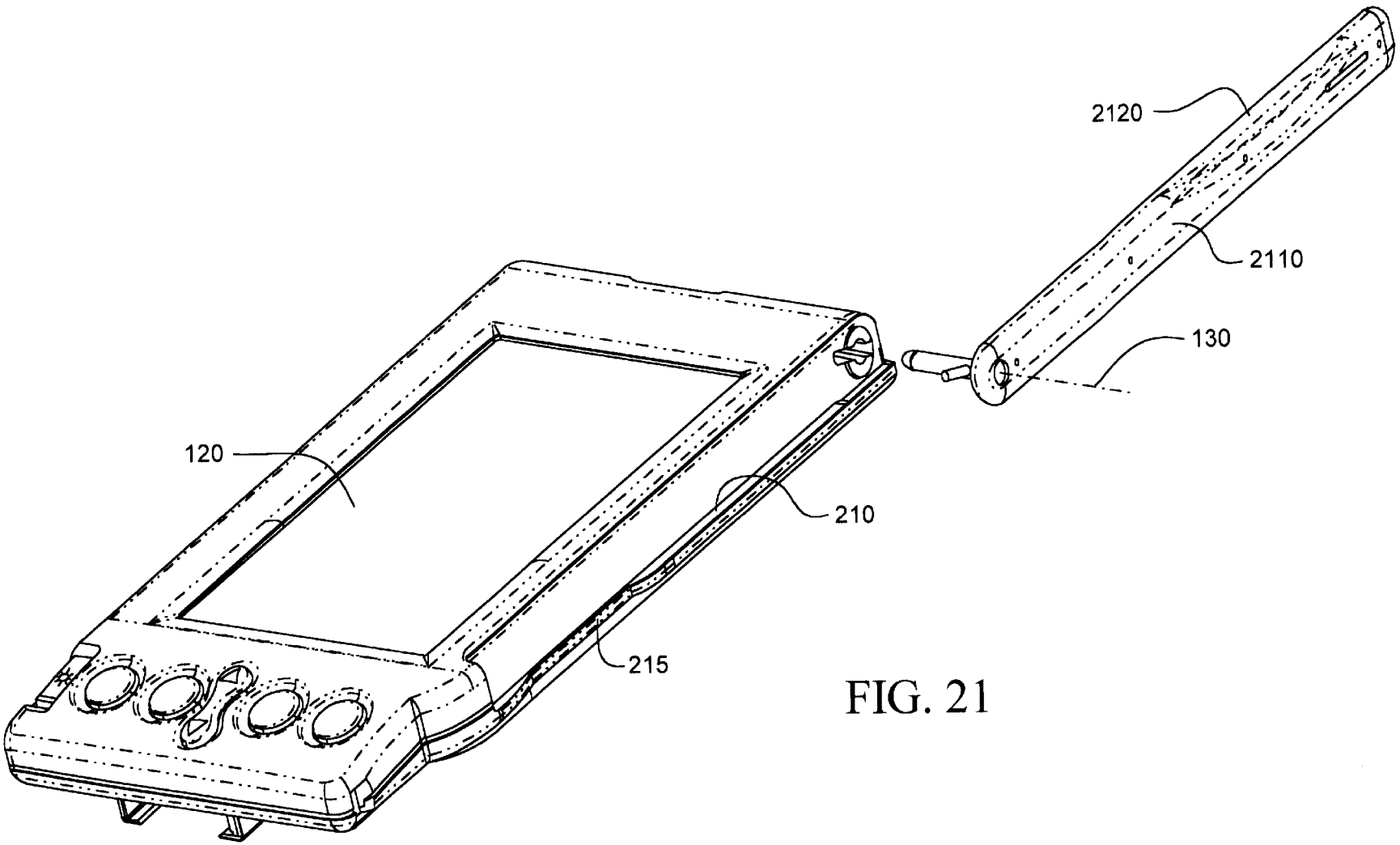
FIG. 21 illustrates a perspective view of a wireless communications device with a detachable antenna removed a short distance and orientated at approximately 180 degrees, representing an embodiment of the invention.

Referring to FIG. 21, another detachable antenna 2110 is depicted a short distance away from the wireless compunctions device 120. The detachable antenna 2110 includes a ridge 2120. The ridge is located adjacent ridge recess 215 in the closure ridge 210 when the detachable antenna 2110 is in the 0 degree position. The ridge 2120 in the detachable antenna 2110 starts flush at one end and rises from the detachable antenna 2110 and then recedes back so as to be flush with the detachable antenna 2110. The ridge 2120 of the detachable antenna 2110 shown in FIG. 5 provides a larger frictional structure for an operator's finger to engage than the rib 310 of the detachable antenna 110 shown in FIGS. 3–4. An important feature of the invention is that either the detachable antenna 110 (FIGS. 1–4) or the detachable antenna 2110 (FIG. 21) can be engaged with the wireless communications device 120.

Referring again to FIG. 21, the ridge 2120 is a protrusion that is formed so as to stand proud from side of the detachable antenna 2110. Namely, the bottom edge of the detachable antenna 2110 has a radius of curvature having a first value near the rotation axis 130. The radius of curvature changes to a second, smaller value along the interval defined by the ridge 2120. The radius of curvature reverts to the first value near the free end of the detachable antenna 2110. Further, The ridge 2120 can be termed a protrusion with a large arc. The protrusion is made by a circular type section that is made to join with the bottom edge of the antenna body and the radius is swept along the bottom edge profile of the antenna. The radius of curvature defined by the bottom edge of the detachable antenna 2110 changes by decreasing in value as a section of interest moves onto the protrusion.

Still referring to FIG. 21, it can be appreciated that the detachable antenna 2110 must be properly positioned with wireless communications device 120 as the detachable antenna 2110 is to be removed (vectored away) from the balance of the wireless communications device 120. The converse is equally applicable when the detachable antenna is to be reattached (vectored toward) to the balance of the wireless communications device 120. The position of the antenna with respect to the balance of the wireless compunctions device 120 will be discussed below in more detail.

Referring to FIG. 5, a front housing 510 from the wireless communications device 120 is depicted. In this view, the detachable antenna (not shown in FIG. 5) has been detached. Replacement of the detachable (e.g., discardable) antenna for the purpose of repair or upgrade can be accomplished by simply pulling the discardable antenna out and snapping in a new antenna.

Still referring to FIG. 5, a cam body 520 is mechanically coupled to the front housing 510. The cam body 520 can be rotated within the front housing 510 about the rotation axis 130. The front housing 510 includes an antenna keyway 530. The cam body 520 includes an antenna key pin slot 540. The antenna keyway 530 and the antenna key pin slot thus combine to define a slot having a short side and a long side. The antenna keyway is adapted to mate with a key pin 630 (shown in FIG. 6), so that the key pin 630 can only be placed within the cam body 520 in one particular orientation, for snap-out removal and snap-in insertion of the detachable antenna. The antenna keyway 530 is disposed on a side of the front housing 510 near the top of the wireless communications device 120.

Still referring to FIG. 5, the antenna key pin slot 540 includes notches 550 that indicate the correct position of the cam body 520 with regard to the front housing 510 for reattachment of the detachable antenna (not shown). The notches 550 must be aligned with the antenna keyway 530 when the detachable antenna is attached. If the notches 550 are not aligned with the antenna keyway 530, the detents and the actuation zone may be out of phase (e.g., by 180 degrees). The notches 550 in the cam body 520 are markers and are to be aligned with the antenna keyway 530 before inserting the detachable antenna so the detachable antenna is not 180 degrees out of phase. Thus, when the cam body 520 is in the position depicted in FIG. 5, the notches 550 are not aligned with the antenna keyway 530, and the detachable antenna (not shown) may, or may not, be detachable from, or reattachable to the front housing 510, but the detachable antenna 110 may not be operable in all respects. More specifically, the optional display power up feature may not be actuated when the detachable antenna 110 is deflected clockwise through the 70 degree position. The reasons for this will discussed below in more detail.

Referring now to FIGS. 1–6, the detachable antenna 110 is shown in more detail. The detachable antenna 110 includes an antenna body 610. With regard to the rest of the wireless communications device 120, the antenna body 610 has a length approximately that of the distance between the bottom of the screen 180 to the top of the wireless communications device 120. The antenna body 610 has a depth adapted to fit along the edge of the wireless communications device 120, and a width corresponding to the thickness of the wireless communications device 120. The antenna body 610 has a flat end 660 and rounded end 670. The flat end 660 is disposed towards the bottom of the wireless communications device 120 at a position corresponding with the bottom of the screen 180. The rounded end 670 is disposed near the top of the wireless communications device 120. The axis of rotation for the antenna body 610 is defined by a signal pin 620 disposed near the rounded end 670 of the detachable antenna 110. The signal pin 620 extends into the wireless communications device 120 from the antenna body 610. A key pin 630 fits through an opening in the signal pin and extends orthogonally outward from both sides of the signal pin 620.

Figure 6:
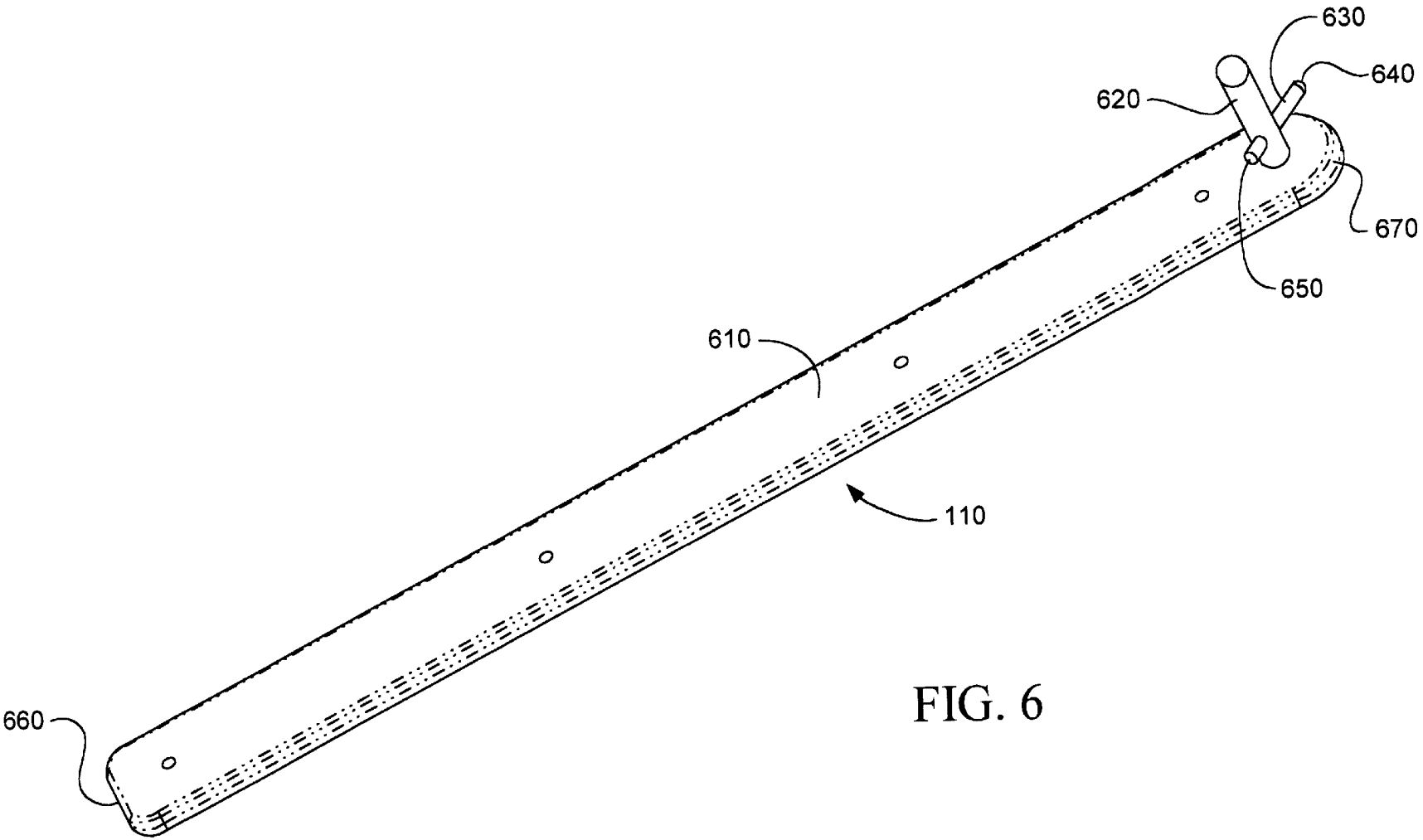
FIG. 6 illustrates a perspective view of the detachable antenna, representing an embodiment of the invention.

Referring to FIG. 6, the antenna body 610 can be a rubber over mold. The rubber over mold can include a flat plate of metal encased within a synthetic polymer. The signal pin 620 can be mechanically coupled to the detachable antenna 110 so as to be substantially perpendicular to a plane defined by the antenna body 610. The signal pin 620 can be swagged onto a flat plate that is then encased in a rubber over mold. Alternatively, a coaxial cable can be embedded instead of a flat sheet, or a plain round wire can be used. The signal pin 620 has two primary functions. First, the signal pin 620 acts as a conduit for a communications signal (e.g., a radio frequency signal). Second, the signal pin 620 acts as a pivot around which the detachable antenna 110 can rotate.

Still referring to FIG. 6, the key pin 630 is mechanically coupled to the signal pin 620. The key pin 630 can pass through the signal pin 620 substantially perpendicular to a center line defined by the signal pin 620. In this way, a plane defined by the key pin 630 can be substantially parallel to the plane defined by the antenna body 610. A first end 640 of the key pin 630 can protrude from the signal pin 620. Similarly, a second end 650 of the key pin 630 can protrude from the signal pin 620. In the embodiment depicted in FIG. 6, the first end 640 of the key pin 630 protrudes from the signal pin 620 further than the second end 650. Thus, the first end 640 of the key pin 630 must be aligned with the antenna keyway 530 shown in FIG. 5 for the key pin 630 to be inserted into the cam body 520. The key pin 630 is offset so it can only be inserted into the front housing 510 in one position. This provides a locking feature when the detachable antenna is rotated out of an insert position (e.g., 180 degrees).

Figure 7:
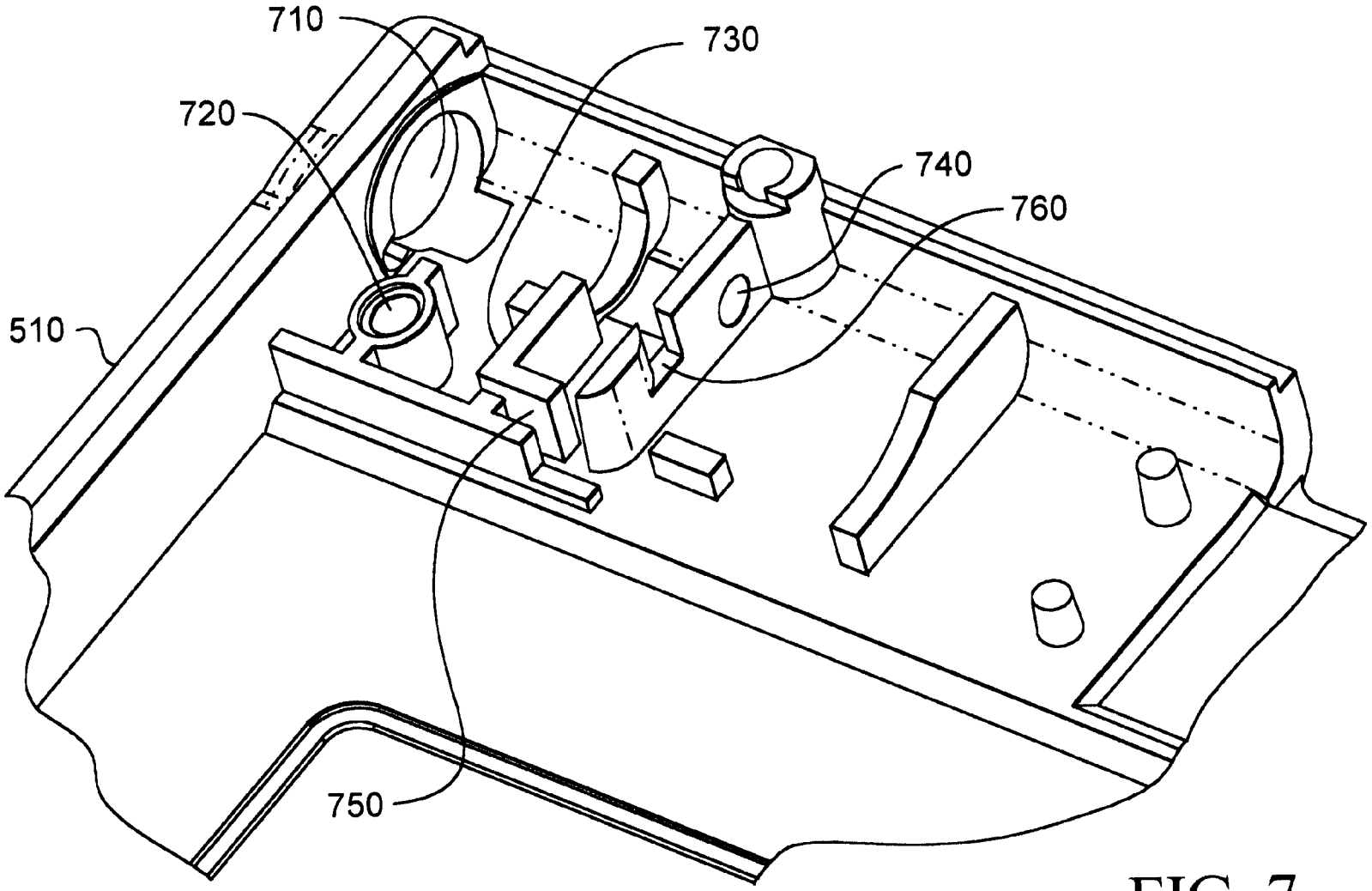
FIG. 7 illustrates a perspective view of the inside of the front housing of the wireless communications device, representing an embodiment of the invention.

Referring to FIG. 7, a view of the inside of the front housing 510 is depicted. The front housing 510 includes a cam body hole 710. The cam body (not shown in FIG. 7) fits in the cam body hole 710 and can be rotated therein. The front housing 510 includes a detent clip screw boss 720. A detent clip (not shown in FIG. 7) is secured to the detent clip screw boss 720. The front housing 510 includes a detent clip alignment leg notch 730. An alignment leg on the detent clip fits in the detent clip alignment leg notch 730. The front housing 510 includes a signal pin hole 740. The signal pin of the detachable antenna (not shown in FIG. 7) fits through the signal pin hole 740. The front housing 510 includes a signal clip barb notch 750. A signal clip (not shown in FIG. 7) fits in the signal clip barb notch 750.

Figure 8:
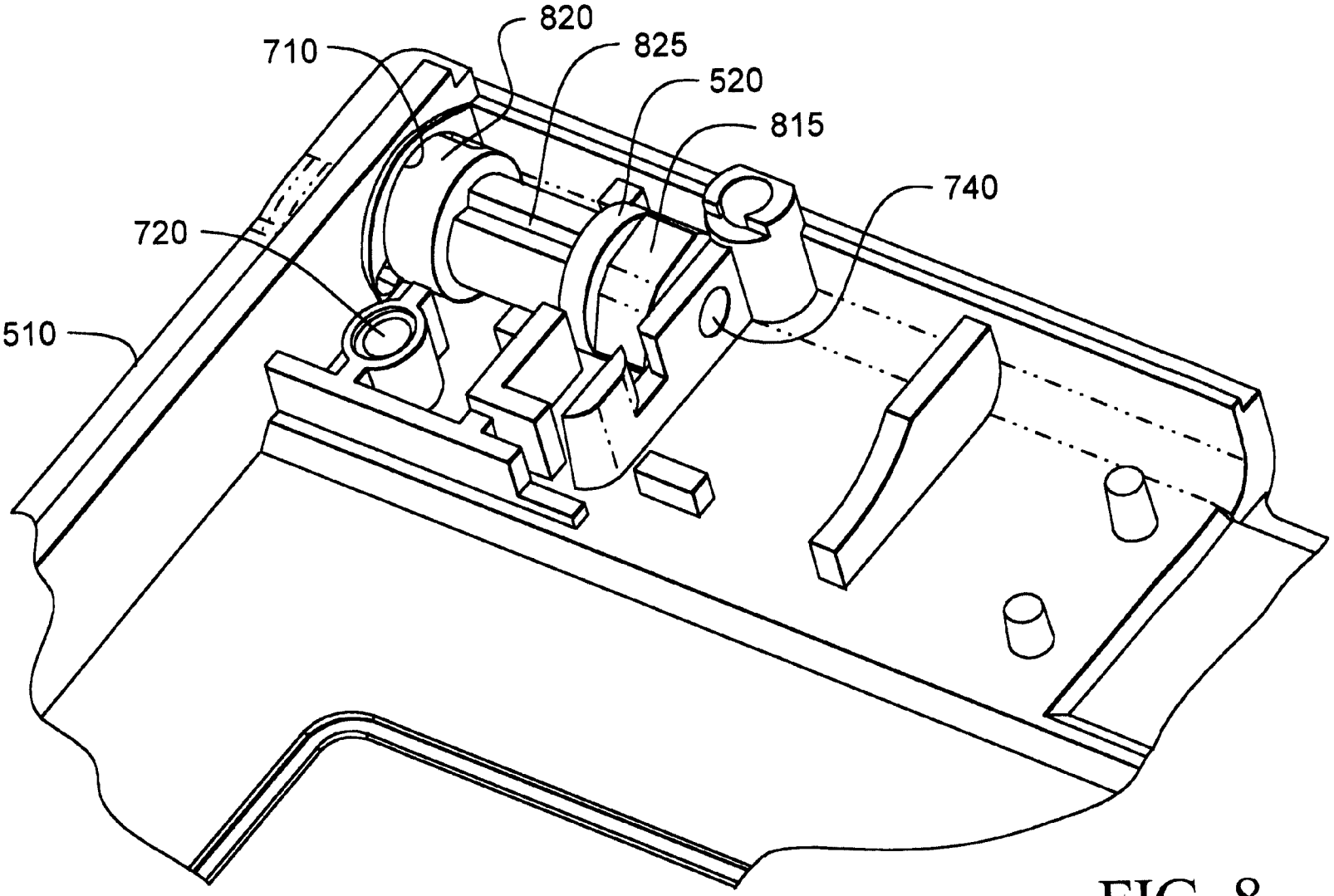
FIG. 8 illustrates a perspective view of the front housing shown in FIG. 7 together with the cam body, representing an embodiment of the invention.

Referring to FIG. 8, a cam body 520 is depicted positioned within the front housing 510. The cam body 520 fits in the cam body hole 710. The cam body 520 can be a single coaxial cam body. The cam body 520 defines a central axis that is coaxial with both the cam body hole 710 and the signal pin hole 740. The cam body 520 is free to rotate about its axis within the front housing 510. It should be noted that the cam body 520 has a plurality of zones, each of which is adapted to a primary purpose. In the depicted embodiment, there are three primary zones. Although one of the functions of the cam body 520 is to provide a cam surface 815, the cam body 520 has other, noncam functions. For example, with regard to the orientation presented in FIG. 8, the left most portion of the cam body 520 defines a circular bearing surface 820 that rides within the cam body hole 710. The circular bearing surface 820 functions to keep the cam body 520 in alignment. As another example, the cam body 520 includes a detent surface 825. The detent surface 825 functions in cooperation with a detent clip (not shown in FIG. 8) to help hold the angular position of the cam body 520. The cam body 520 provides all of the functions of fixing, indexing, and actuating.

Figure 9:
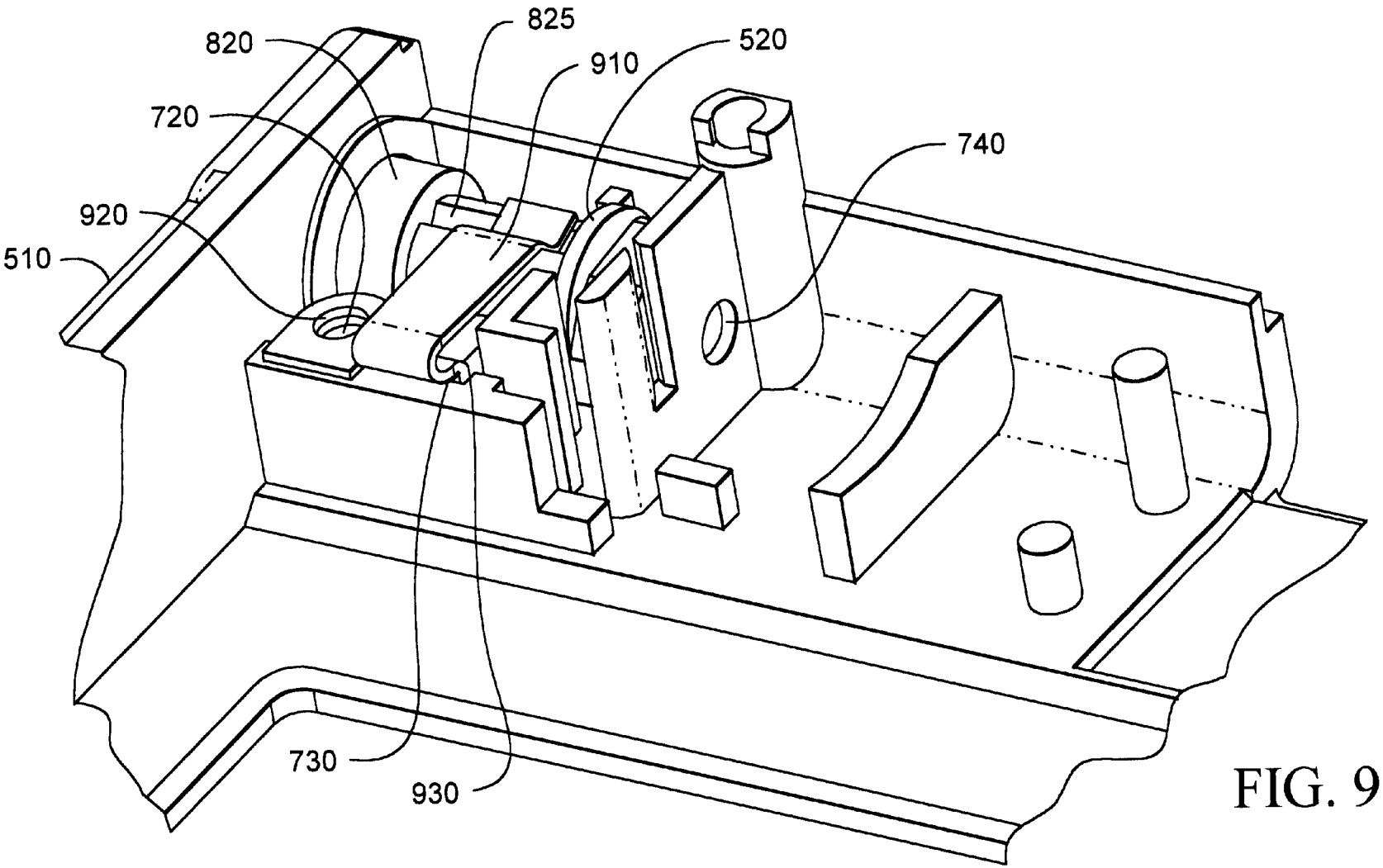
FIG. 9 illustrates a perspective view of the front housing shown in FIGS. 7–8 together with the cam body and a detent clip, representing an embodiment of the invention.

Referring to FIG. 9, a detent clip 910 is depicted in mechanical engagement with the cam body 520. The detent clip 910 is in engagement with, and exerts a force against, the detent surface 825 of the cam body 520. The detent clip 910 is mechanically coupled to the front housing 510. A screw hole 920 in the detent clip 910 is aligned with the detent clip screw boss 720. A screw or bolt (not shown in FIG. 9) can be inserted through the screw hole 920 and secured to the detent clip screw boss 720, thereby holding the detent clip 910 against the detent clip screw boss 720. The detent clip 910 includes a detent alignment leg 930 that is in frictional engagement with the front housing 510. The detent alignment leg 930 on the detent clip 910 is inserted into the detent clip alignment leg notch 730, thereby keeping the detent clip from rotating when the screw or bolt is tightened.

Figure 10:
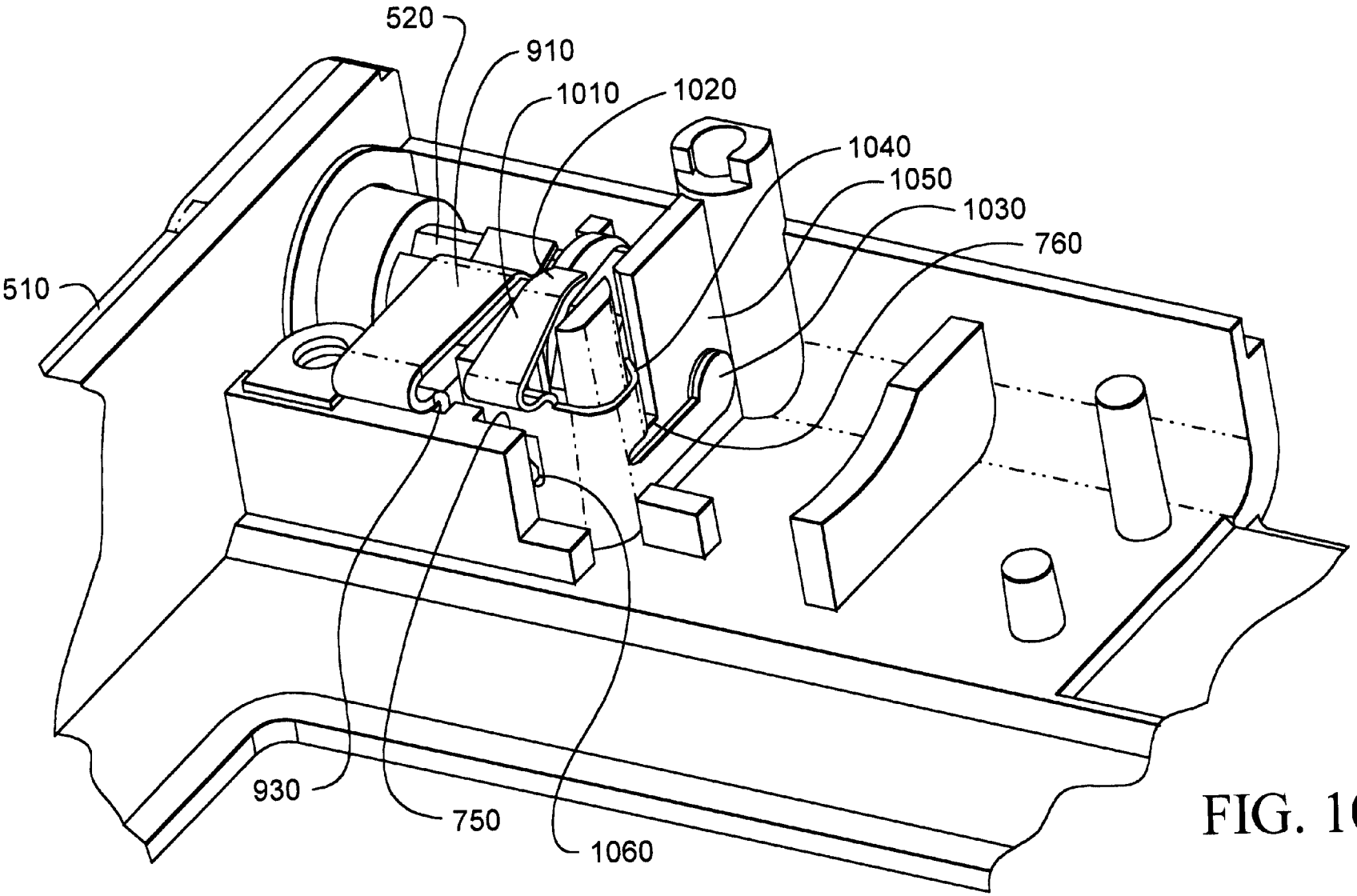
FIG. 10 illustrates a perspective view of the front housing depicted in FIGS. 7–9 together with the cam body, the detent clip, and a signal clip, representing an embodiment of the invention.

Referring to FIG. 10, a signal clip 1010 is mechanically coupled to the front housing 510. The signal clip 1010 can also be termed a contact clip. The signal clip 1010 includes a circuit board contact 1020. The signal clip 1010 includes a signal pin contact 1030. The signal pin contact 1030 is in mechanical engagement with, and exerts a force against, the signal pin (not shown in FIG. 10). A signal clip barb 1060 of the signal clip 1010 fits in the signal clip barb notch 750. The signal clip 1010 includes a retaining hook 1040 that is in frictional engagement with the front housing 510. The retaining hook 1040 of the signal clip 1010 fits in the signal clip retaining hook notch 760. The coaction of the retaining hook 1040 and the signal clip barb notch 750 of the front housing 510 keeps the signal clip 1010 flush against an alignment wall 1050. All of the parts shown in FIG. 10 can be replaced.

Figure 11:
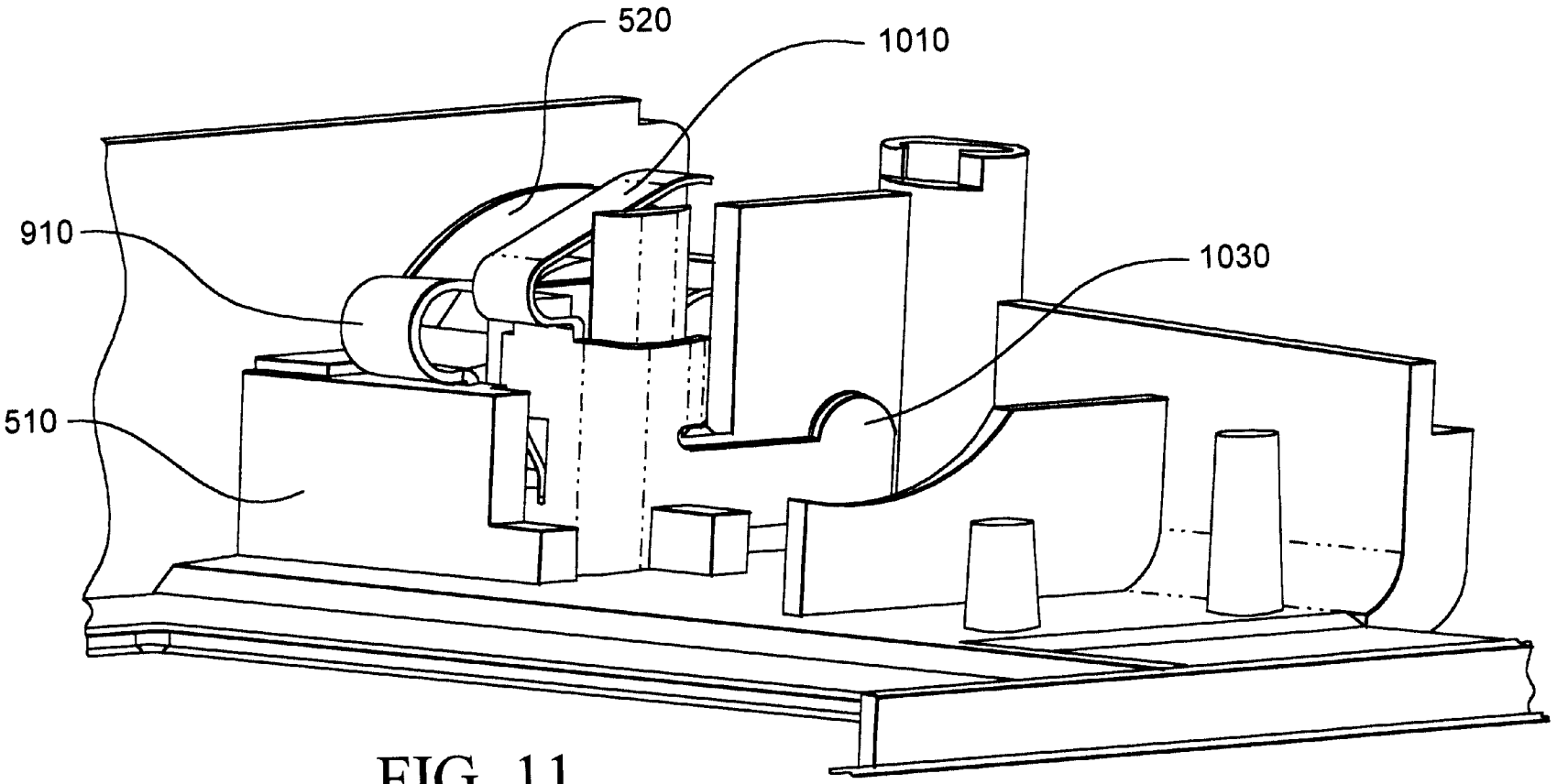
FIG. 11 illustrates a different perspective view of the front housing depicted in FIGS. 7–10 together with the detent clip and the signal clip, representing an embodiment of the invention.

Referring to FIG. 11, a slightly different perspective on the front housing 510, the cam body 520, the detent clip 910 and the signal clip 1010 is depicted. It can be appreciated that the subassembly is compact and structurally integrated.

Figure 12:
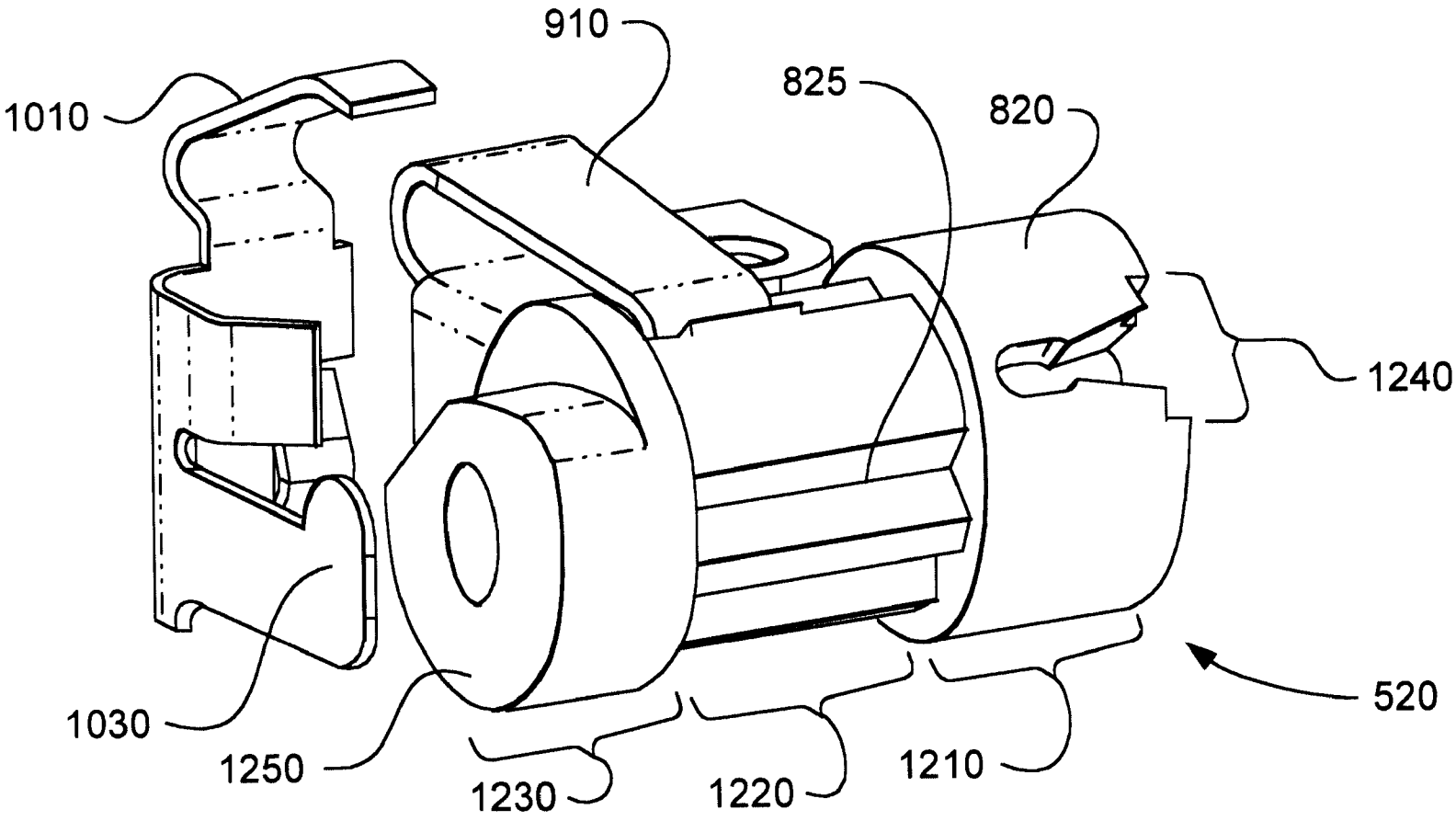
FIG. 12 illustrates a perspective view of the cam body, the detent clip, and the signal clip, representing an embodiment of the invention.

Referring to FIG. 12, the cam body 520 will now be described in more detail. The cam body 520 includes a retaining zone 1210. The retaining zone includes the circular bearing surface 820 and the antenna key pin slot 540. The cam body 520 includes an indexing zone 1220. The indexing zone 1220 includes the detent surface 825. The cam body 520 includes a micro switch activation zone 1230. The micro switch activation zone 1230 includes the cam surface 815. The retaining zone 1210, the indexing zone 1220, and the micro switch activation zone 1230 are coaxial and provide the cam body 520 with three discreet functions. The detent clip 910 is depicted in mechanical engagement with the detent surface 825 of the indexing zone 1220 in FIG. 12.

Still referring to FIG. 12, the function of the retaining zone 1210 is to hold the key pin (not shown in FIG. 12) of the detachable antenna (not shown in FIG. 12) when the detachable antenna is attached to the wireless communications device (not shown in FIG. 12). The function of the indexing zone 1220 is to help maintain particular angular positions of the cam body 520 with regard to the wireless communications device. The angular alignment of the cam body 520 can be resistably fixed in a plurality of positions by the coaction of the detent clip 910 with the plurality of parallel slots 1240 that are arranged on the outer circumference of the indexing zone 1220. The plurality of parallel slots 1240 can be located so that the detachable antenna 110 will exhibit a resistance to moving from various angular positions (e.g., 90, 135, 180 degrees). The function of the micro switch activation zone 1230 is to actuate an electrical contact switch (not shown in FIG. 12) so as to conduct an RF signal to and/or from the signal pin (not shown in FIG. 12) of the detachable antenna. A lobe 1250 on the cam body 520 activates the electrical contact switch to indicate that the detachable antenna is engaged. If the unit is off, engaging the antenna will turn the unit on.

Figure 13:
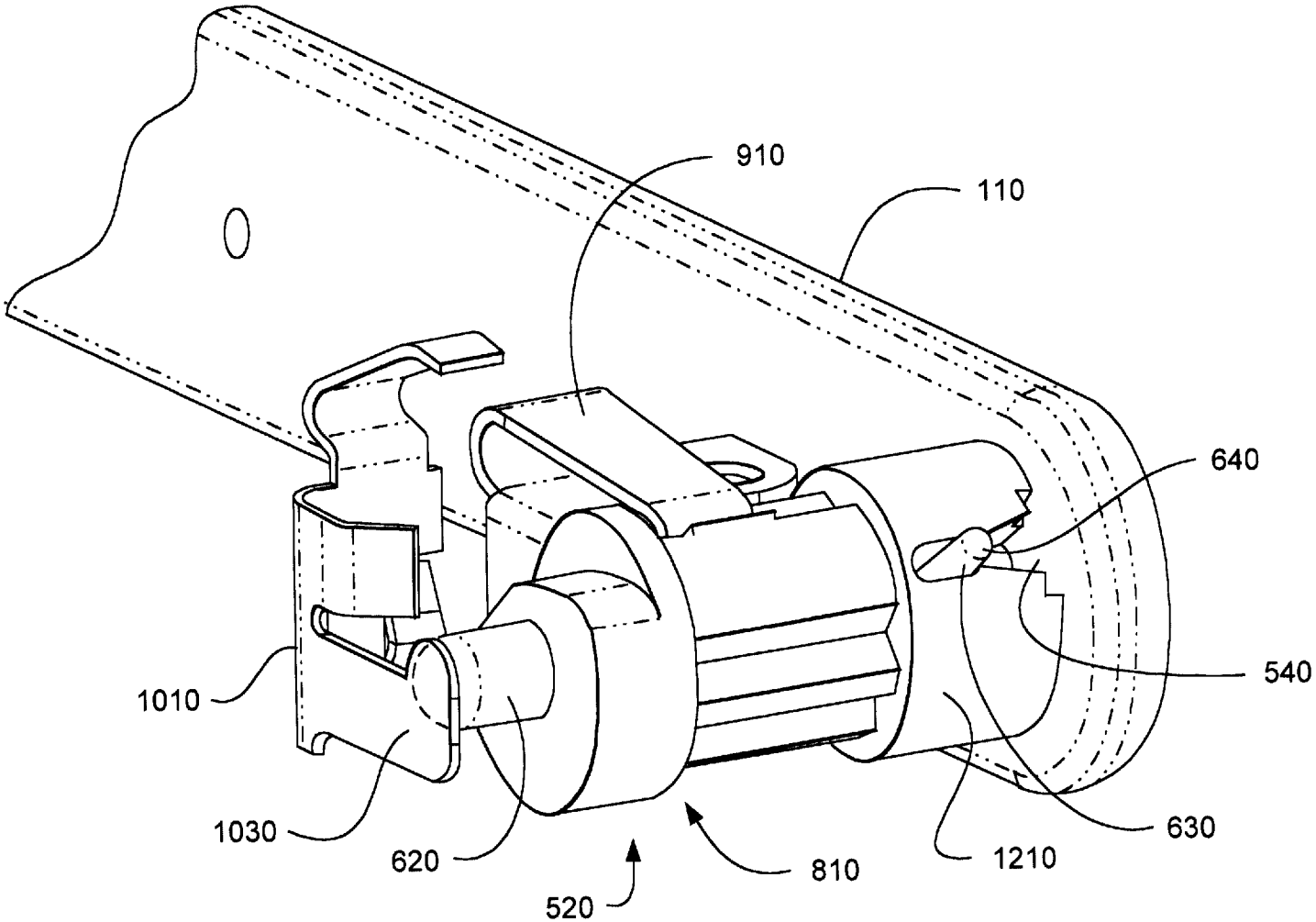
FIG. 13 illustrates a perspective view of the cam body, the detent clip, the signal clip, and the detachable antenna, representing an embodiment of the invention.

Referring to FIG. 13, the cam body 520, the detent clip 910, and the signal clip 1010 are depicted in combination with the detachable antenna 110. It can be appreciated that the signal pin 620 passes through the cam body 520 and is in both mechanical and electrical contact with the signal clip 1010. The signal slip 1010 exerts a small force against the signal pin 620. It can also be appreciated that the key pin 630 is in a snap fit engagement with the retaining zone 1210. The key pin 630 snaps into the slot 540 in the retaining zone 1210 of the cam body 520. Upon insertion of the detachable antenna 110 into the cam body 520, movement of the signal pin 620 through the cam body 520 is stopped by the detachable antenna 110 coming flush with the retaining zone 1210 of the cam body 520. Thus, rotation of the detachable antenna 110 will cause rotation of the cam body 520. The first end 640 of the key pin 630 protrudes beyond the outer circumference defined by the retaining zone 1210. It can be appreciated that the detents are used for locking the antenna in place and are also used in removing the detachable antenna 110. The detachable antenna 110 can be of a length between ½ wave and ¼ wave, and yet function like a ½ wave due to the length of the circuitry within the wireless communications device 120. Part of the length that makes the detachable antenna 110 function like a ½ wave antenna comes from the length of the signal pin 620 and the length of the signal clip 1010.

Figure 14:
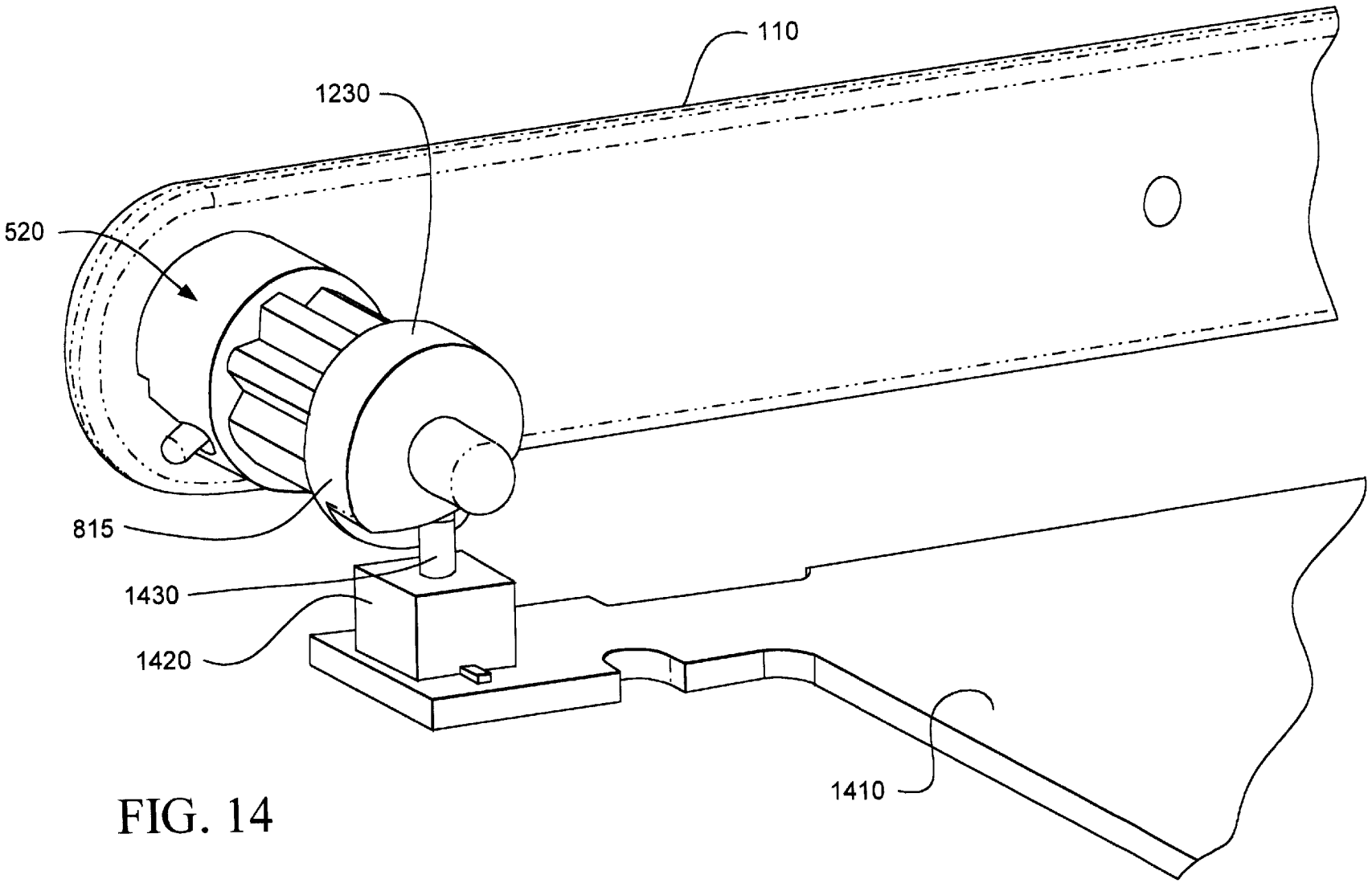
FIG. 14 illustrates a perspective view of the cam body, the detachable antenna, and a circuit board with an electrical contact switch, representing an embodiment of the invention.

Referring to FIG. 14, the detachable antenna 110 and the cam body 520 are depicted in combination with a PCB 1410. The PCB 1410 is a circuit board. The PCB 1410 includes a micro switch 1420. The micro switch 1420 includes a plunger 1430. The plunger 1430 is in mechanical engagement with the cam surface 815 of the micro switch activation zone 1230. It can be appreciated that rotation of the detachable antenna 110 will cause rotation of the micro switch activation zone 1230, thereby changing the extent to which the piston protrudes from the micro switch 1420 in the same way that a cam follower moves in relation to a cam. In the embodiment depicted in FIG. 14, the micro switch 1420 is in a noncontact (nonconductive) state when the piston 1430 is in contact with the low point of the micro switch activation zone 1230.

Figure 15:
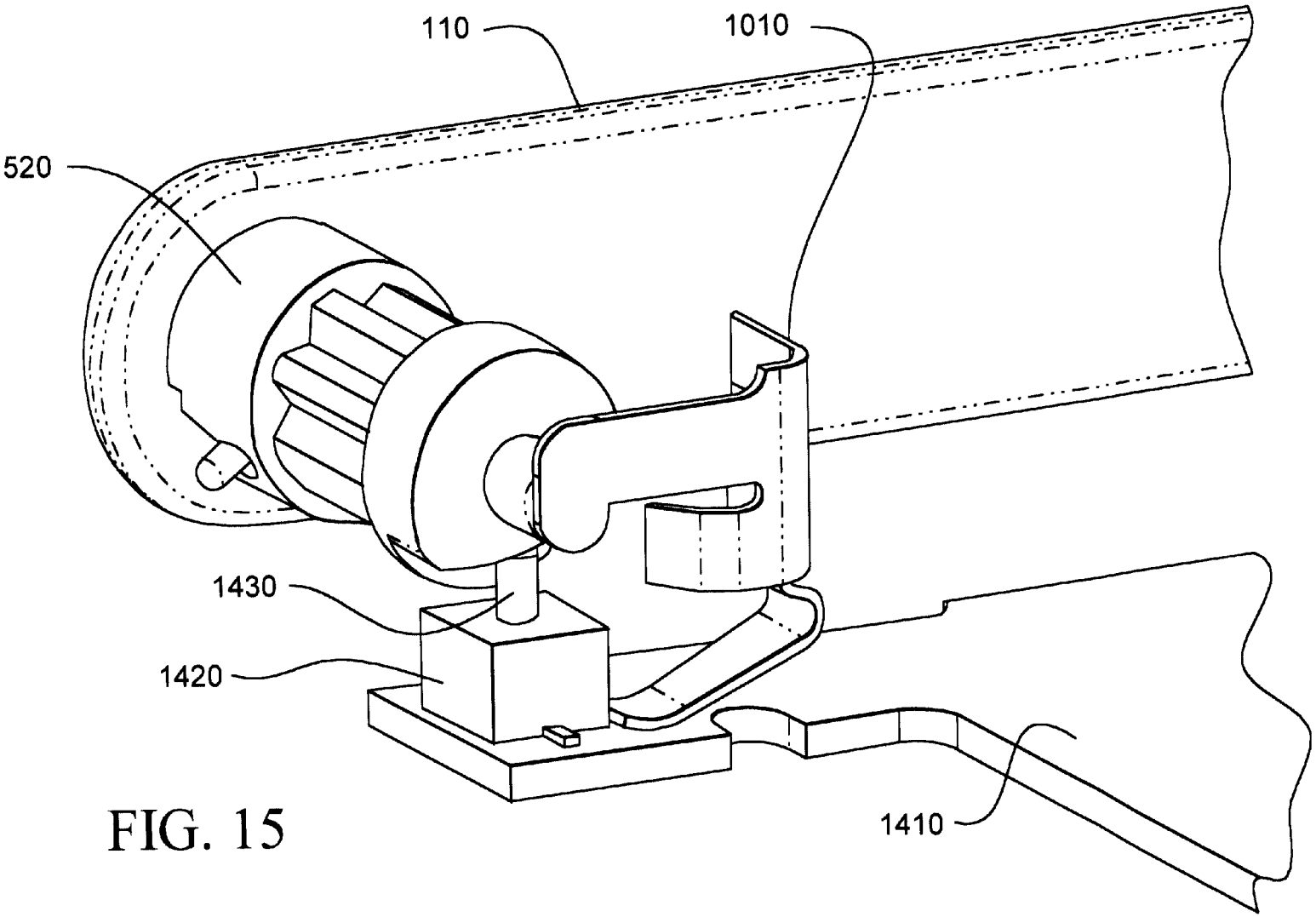
FIG. 15 illustrates a perspective view of the cam body, the detachable antenna, the circuit board with the electrical contact switch, and the signal clip, representing an embodiment of the invention.

Referring to FIG. 15, the detachable antenna 110, the cam body 520, and the PCB 1410 are depicted in combination with the signal clip 1010. It can be appreciated that the micro switch 1420 can be connected in electrical series with the electrical contact 1020 of the signal clip 1010. Thus, the angular position of the detachable antenna 110 can be used to control the electrical contact state between the signal pin 630 and the PCB 1410 via the micro switch 1420.

Figure 16B:
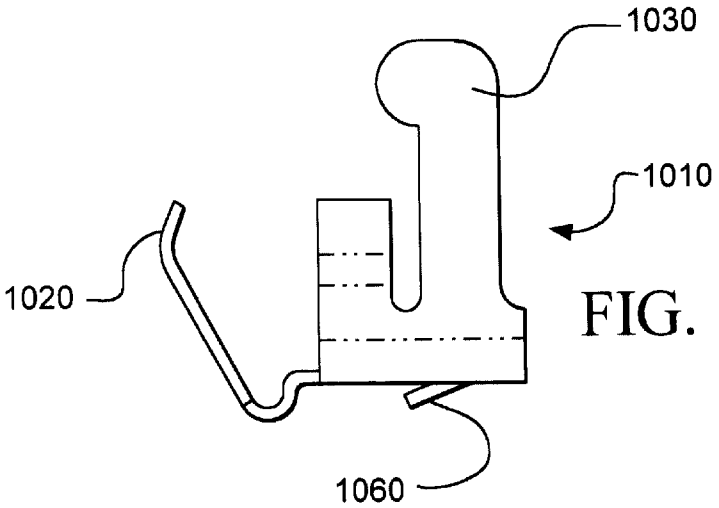
FIGS. 16A–16C illustrate orthographic views of the signal clip, representing an embodiment of the invention.
Figure 16C:
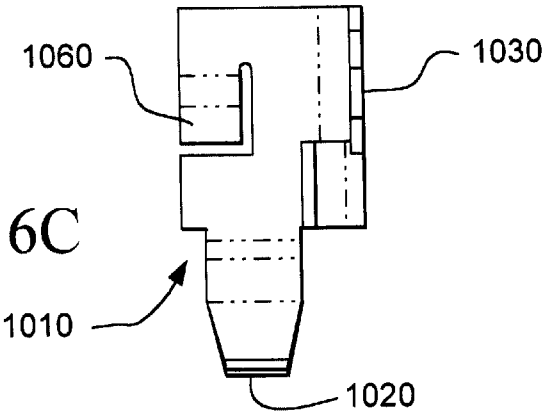
Figure 16A:
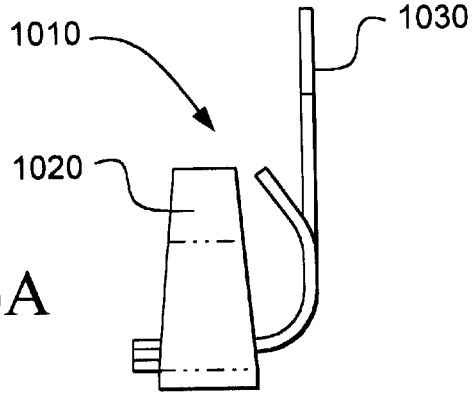

Referring to FIGS. 16A–16C, three orthographic views of the signal clip 1010 are depicted. With regard to the inside of the front housing (not shown in FIGS. 16A–16C). FIGS. 16A illustrates a top view of the signal clip 1010. FIG. 16B illustrates a side view of the signal clip 1010 looking toward the signal pin (not shown in FIGS. 16A–16C). FIG. 16C shows an upside down side view of the signal clip 1010 looking away from the cam body (not shown in FIG. 16C). The signal clip barb 1060 is wedged into the signal clip barb notch 750 (not shown in FIGS. 16A–16C).

Figure 17B:
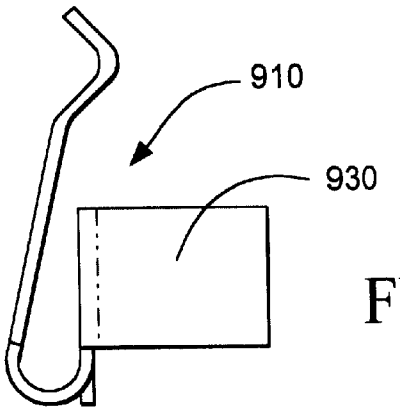
FIGS. 17A–17C illustrate orthographic views of the detent clip, representing an embodiment of the invention.
Figure 17C:
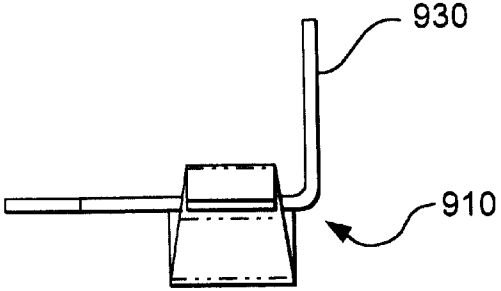
Figure 17A:
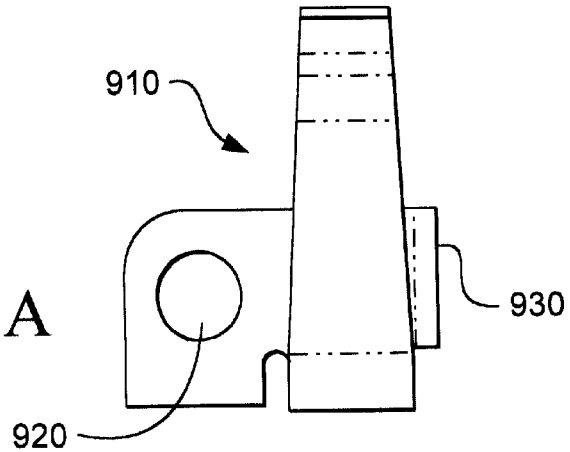

Referring to FIGS. 17A–17C, three orthographic views of the detent clip 910 are depicted. With regard to the inside of the front housing (not shown in FIGS. 17A–17C), FIG. 17A depicts a top view of the detent clip 910. FIG. 17B depicts a side view of the detent clip 910 looking toward the detachable antenna (not shown in FIG. 17B). FIG. 17C shows an upside down side view of the detent clip 910 looking away from the cam body (not shown in FIG. 17C).

Figure 18:
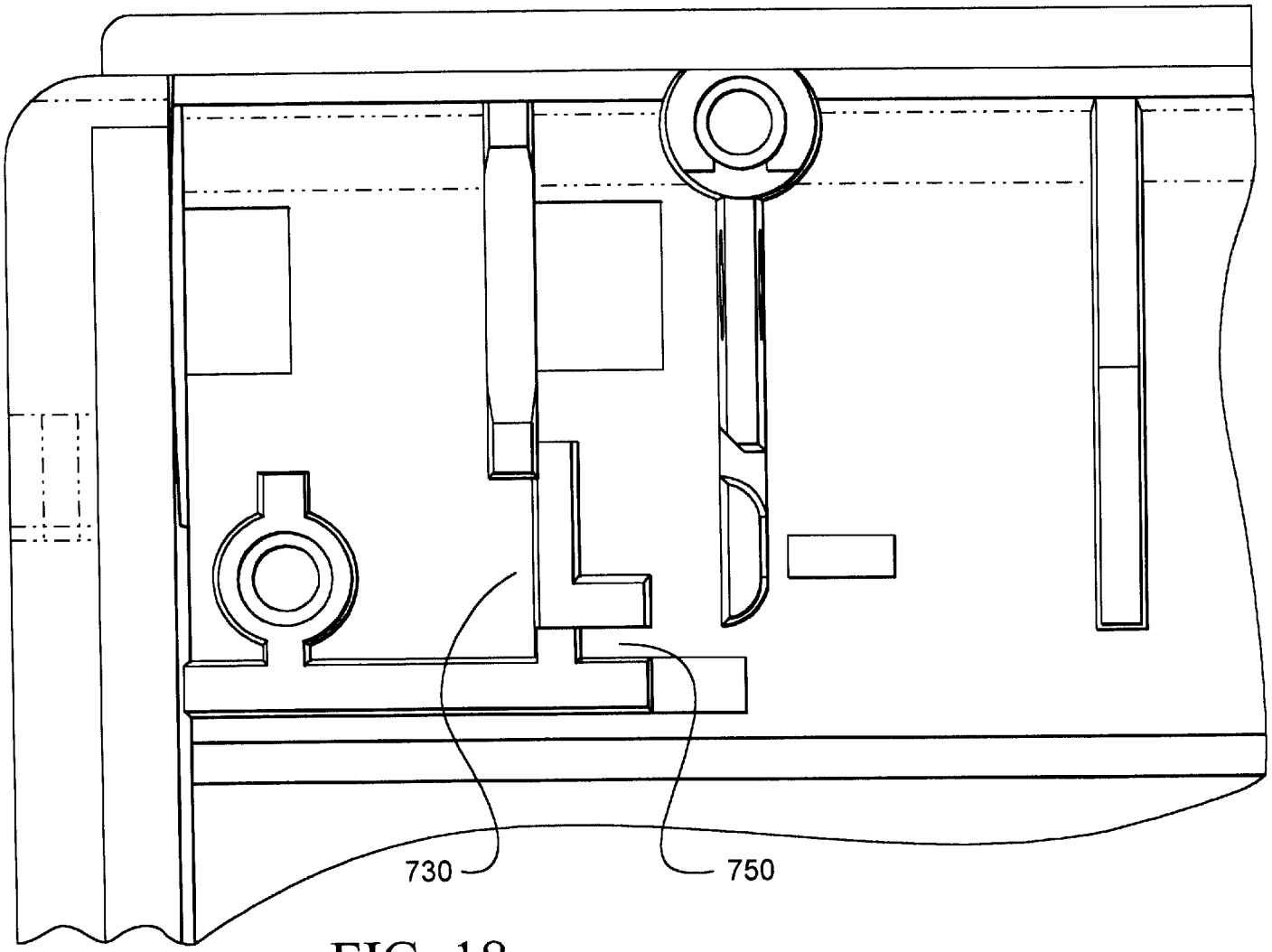
FIG. 18 illustrates an orthographic view of the inside of the front housing of the wireless communications device, representing an embodiment of the invention.

FIG. 18 depicts an orthographic top view of the inside of the front housing 510. It can be appreciated that the detent clip alignment leg notch 730 provides an alignment function with regard to the detent clip (not shown in FIG. 18). Similarly, it can be appreciated that the signal clip barb notch 750 provides an alignment function with regard to the signal clip (not shown in FIG. 18).

Figure 19:
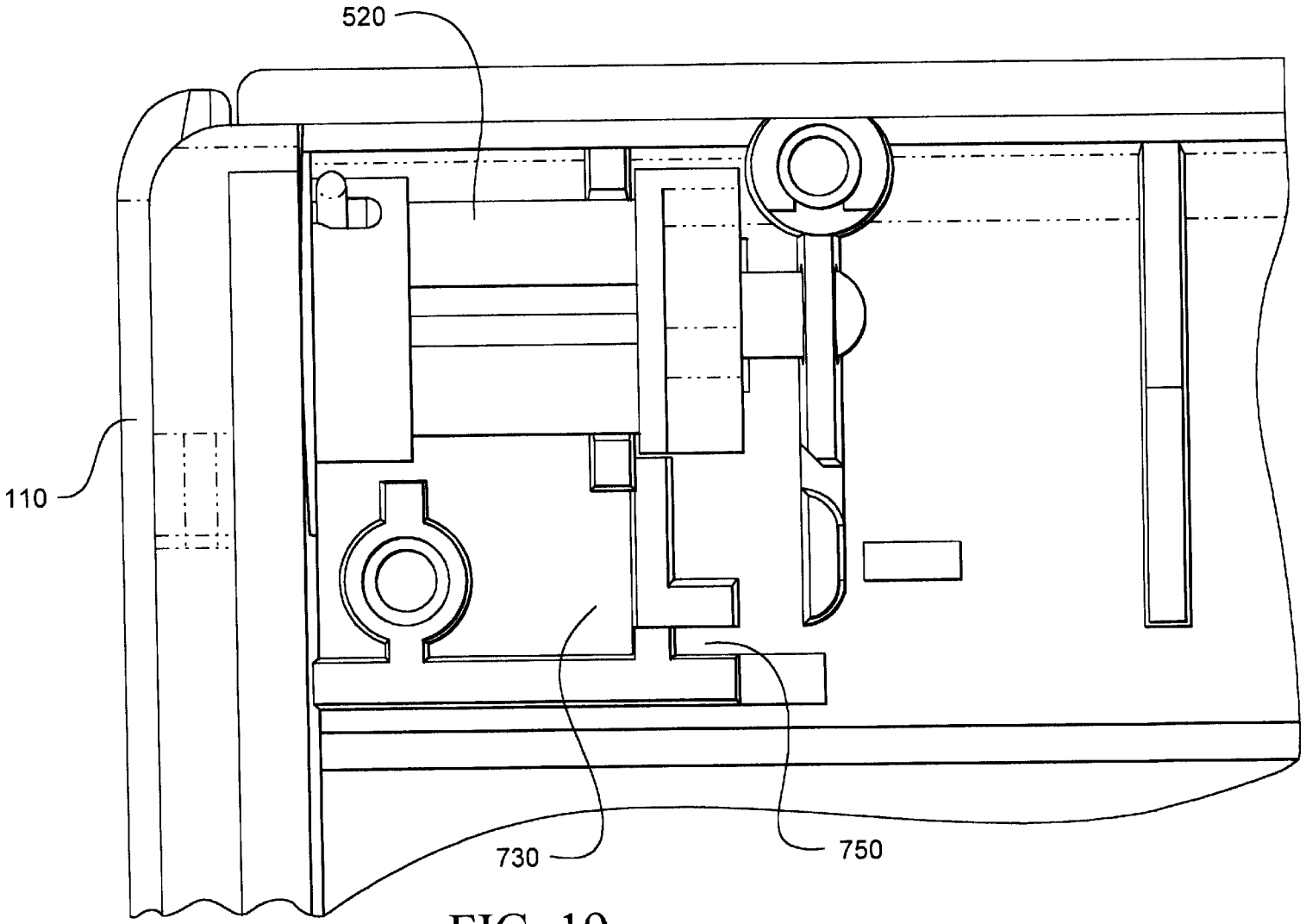
FIG. 19 illustrates an orthographic view of the front housing depicted in FIG. 18 with the cam body in position, representing an embodiment of the invention.

FIG. 19 depicts an orthographic top view of the inside of the front housing 510 with the detachable antenna 110 and the cam body 520 in position. It can be appreciated that the signal pin 630 of the detachable antenna passes through and protrudes beyond the cam body 520 so as to be an electrical conduction with the signal clip (not shown in FIG. 19).

Figure 20:
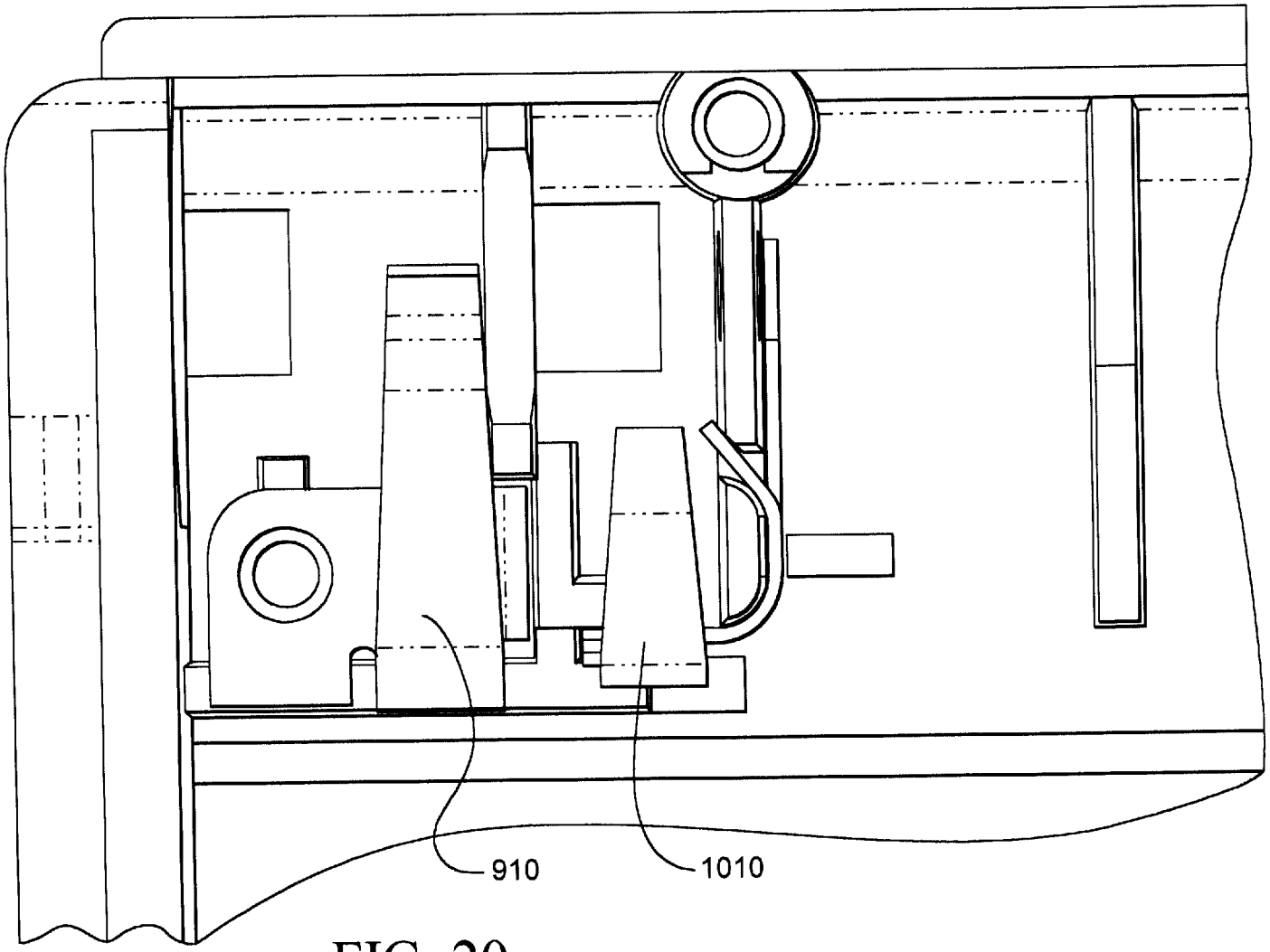
FIG. 20 illustrates an orthographic view of the front housing depicted in FIGS. 18–19 with the detent clip, and the signal clip in position, representing an embodiment of the invention.

Referring to FIG. 20, an orthographic top view of the inside of the front housing 510 is depicted in combination with the signal clip 1010, the detent clip 910 and a portion of the detachable antenna 110 (the signal pin of the detachable antenna 110 is not depicted in FIG. 20). It can be appreciated from the viewpoint shown in FIG. 20 that the signal clip 1010 and the detent clip 910 are held in place with a minimum of fasteners.

Practical Applications of the Invention

A practical application of the invention that has value within the technological arts is as an antenna on a wireless communications device. Further, the invention is useful in conjunction with cellular telephones (such as are used for the purpose of voice communications), or in conjunction with satellite signal reception (such as are used for the purpose of global positioning), or the like. There are virtually innumerable uses for the invention, all of which need not be detailed here.

Advantages of the Invention

A detachable antenna, representing an embodiment of the invention, can be cost effective and advantageous for at least the following reasons. The detachable antenna is user replaceable. The detachable antenna is based on a compact design. The detachable antenna is easy to replace, without tools. The detachable antenna itself has no moving parts. As a result, all of the functionality is inside the housing, protected from the user. In some embodiments, the antenna can only can replaced/removed in a specific orientation (e.g., at 180 degrees). The cam surface activates a microswitch to tell the unit that the antenna has been deployed and turns on the unit. This happens at about 75 degrees. Also, detents are built into the cam body that give the user feedback when the antenna is at 90, 135 and 180 degrees. The cam body, detent clip and signal clip can be replaced if one or all cease to function properly or wear out.

All the disclosed embodiments of the invention described herein can be realized and practiced without undue experimentation. Although the best mode of carrying out the invention contemplated by the inventors is disclosed above, practice of the invention is not limited thereto. All the disclosed elements and features of each disclosed embodiment can be combined with, or substituted for, the disclosed elements and features of every other disclosed embodiment except where such elements or features are mutually exclusive.

It will be manifest that various additions, modifications and rearrangements of the features of the invention may be made without deviating from the spirit and scope of the underlying inventive concept. It is intended that the scope of the invention as defined by the appended claims and their equivalents cover all such additions, modifications, and rearrangements. The appended claims are not to be interpreted as including means-plus-function limitations, unless such a limitation is explicitly recited in a given claim using the phrase "means-for."

What is claimed is:

1. A detachable antenna, comprising:

a cam body defining a rotation axis, said cam body including a retaining zone having a snap-fit receptacle;

a signal pin including a first signal pin end and a second signal pin end;

an antenna conductively coupled to said first signal pin end; and a key pin that extends from said signal pin, said key pin i) having a first key pin end and a second key pin end, and ii) being snap-fit into said snap-fit receptacle.

2. The detachable antenna of claim 1, wherein said first key pin end extends from said signal pin so as to define a key length, and said second key pin end extends from said signal pin so as to define a distance that is shorter than said key length.

3. The detachable antenna of claim 2, further comprising a housing mechanically coupled to said cam body so that said cam body can be rotated around said rotation axis, wherein said housing includes a keyway that provides clearance for said key length.

4. The detachable antenna of claim 3, wherein said retaining zone includes an alignment notch.

5. The detachable antenna of claim 1, wherein said cam body includes an indexing zone.

6. The detachable antenna of claim 5, wherein said signal pin passes through said indexing zone.

7. The detachable antenna of claim 5, wherein said indexing zone defines a detent surface, and, further comprising a detent clip mechanically coupled to said detent surface.

8. The detachable antenna of claim 7, wherein said detent clip includes an alignment leg.

9. The detachable antenna of claim 1, wherein said cam body includes an activation zone.

10. The detachable antenna of claim 9, wherein said signal pin passes through said activation zone.

11. The detachable antenna of claim 9, wherein said activation zone defines a cam surface, and, further comprising a follower mechanically coupled to said cam surface.

12. The detachable antenna of claim 11, further comprising a contact switch mechanically coupled to said follower, wherein an electrical state of said contact switch to controlled by a position of said follower.

13. The detachable antenna of claim 12, further comprising a circuit board conductively coupled to said contact switch.

14. The detachable antenna of claim 1, wherein said signal pin passes through said cam body, and, further comprising a signal clip conductively coupled to said second end of said signal pin.

15. The detachable antenna of claim 14, wherein said signal clip includes a retaining hook.

16. The detachable antenna of claim 14, wherein said signal clip includes a contact pad.

17. The detachable antenna of claim 16, further comprising a circuit board conductively coupled to said contact pad.

18. The detachable antenna of claim 1, wherein said antenna includes a protrusion.

19. A wireless communications device, comprising:

a cam body defining a rotation axis, said cam body including a retaining zone having a snap-fit receptacle;

a signal pin including a first signal pin end and a second signal pin end;

an antenna conductively coupled to said first signal pin end; and a key pin that extends from said signal pin, said key pin i) having a first key pin end and a second key pin end, and ii) being snap-fit into said snap-fit receptacle.

20. The wireless communications device of claim 19, wherein said first key pin end extends from said signal pin so as to define a key length, and said second key pin end extends from said signal pin so as to define a distance that is shorter than said key length.

21. The wireless communications device of claim 20, further comprising a housing mechanically coupled to said cam body so that said cam body can be rotated around said rotation axis, wherein said housing includes a keyway that provides clearance for said key length.

22. The wireless communications device of claim 21, wherein said retaining zone includes an alignment notch.

23. The wireless communications device of claim 19, wherein said cam body includes an indexing zone.

24. The wireless communications device of claim 23, wherein said signal pin passes through said indexing zone.

25. The wireless communications device of claim 23, wherein said indexing zone defines a detent surface, and, further comprising a detent clip mechanically coupled to said detent surface.

26. The wireless communications device of claim 25, wherein said detent clip includes an alignment leg.

27. The wireless communications device of claim 19, wherein said cam body includes an activation zone.

28. The wireless communications device of claim 27, wherein said signal pin passes through said activation zone.

29. The wireless communications device of claim 27, wherein said activation zone defines a cam surface, and, further comprising a follower mechanically coupled to said cam surface.

30. The wireless communications device of claim 29, further comprising a contact switch mechanically coupled to said follower, wherein an electrical state of said contact switch to controlled by a position of said follower.

31. The wireless communications device of claim 30, further comprising a circuit board conductively coupled to said contact switch.

32. The wireless communications device of claim 19, wherein said signal pin passes through said cam body, and, further comprising a signal clip conductively coupled to said second end of said signal pin.

33. The wireless communications device of claim 32, wherein said signal clip includes a retaining hook.

34. The wireless communications device of claim 32, wherein said signal clip includes a contact pad.

35. The wireless communications device of claim 34, further comprising a circuit board conductively coupled to said contact pad.

36. The wireless communications device of claim 19, wherein said antenna includes a protrusion.

37. A method of attaching a detachable antenna to a wireless communications device, said method comprising:

providing a detachable antenna that includes a signal pin and a key pin connected to said signal pin;

inserting said key pin and at least part of said signal pin into a cam body that composes said wireless communications device so as to define a first detachable antenna position; and deflecting said detachable antenna from said first position to a second position.

38. The method of claim 37, wherein inserting includes forcing said key pin into snap-fit engagement with a retaining zone that composes said cam body.

39. The method of claim 37, wherein deflecting includes rotating said cam body.

40. The method of claim 37, further comprising deflecting said detachable antenna from said second position to a third position so as to turn a display on.

41. The method of claim 37, further comprising deflecting said detachable antenna from said second position to said first position and detaching said detachable antenna from said wireless communications device.

42. A method of detaching a detachable antenna from a wireless communications device, said method comprising:

providing said detachable antenna with a signal pin and a key pin connected to said signal pin;

deflecting said detachable antenna from a first position to a second position; and removing said key pin and at least part of said signal pin from a cam body that composes said wireless communications device.

43. The method of claim 42, wherein deflecting includes rotating said cam body.

44. The method of claim 42, further comprising:

inserting said key pin and at least part of said signal pin into said cam body; and deflecting said detachable antenna from said second position to said first position.

45. The method of claim 42, further comprising:

providing another detachable antenna that includes another signal pin and another key pin connected to said another signal pin;

inserting said another key pin and at least part of said another signal pin into said cam body; and deflecting said another detachable antenna from said second position to said first position.

* * * * *